US005640646A

United States Patent [19]

Toyohara et al.

[11] Patent Number: 5,640,646

[45] Date of Patent: Jun. 17, 1997

[54] IMAGE FORMING APPARATUS CAPABLE OF CONTROLLING HEATING UNITS UNDER OPTIMUM DRIVING MODE AND A METHOD FOR CONTROLLING THE SAME

[75] Inventors: Mie Toyohara; Yoshinori Wada, both of Kawasaki, Japan

[73] Assignee: Fujitsu Limited, Kawasaki, Japan

[21] Appl. No.: 277,431

[22] Filed: Jul. 18, 1994

[30] Foreign Application Priority Data

Sep. 17, 1993 [JP] Japan ..... 5-231391
Mar. 9, 1994 [JP] Japan ..... 6-038597

[51] Int. Cl.[6] ..... G03G 15/20

[52] U.S. Cl. ..... 399/69

[58] Field of Search ..... 355/285, 286, 355/289; 219/216, 482, 490, 492

[56] References Cited

U.S. PATENT DOCUMENTS

| | | | |
|---|---|---|---|
| 4,615,609 | 10/1986 | Honma | 355/209 X |
| 4,740,671 | 4/1988 | Kuroda et al. | 219/492 |
| 4,878,092 | 10/1989 | Arai | 355/285 |
| 5,220,389 | 6/1993 | Kishimoto et al. | 355/285 |

FOREIGN PATENT DOCUMENTS

| | | |
|---|---|---|
| 59-153221 | 9/1984 | Japan . |
| 1-107286 | 4/1989 | Japan . |
| 1-113768 | 5/1989 | Japan . |

*Primary Examiner*—Fred L. Braun
*Attorney, Agent, or Firm*—Armstrong, Westerman, Hattori, McLeland & Naughton

[57] ABSTRACT

When a time mode is selected, after power to the apparatus as a whole is cut off, the time until the scheduled start of supply of power to the heating units is counted. When the scheduled time of the start of supply of power is reached, power starts to be supplied to the heating units. When the continuous mode is selected, instruction is given to continue supplying power to the heating units even when power to the apparatus as a whole is turned off. Also, when a service start time is input, the next build-up time is predicted or the amount of power previously supplied to the heating units is changed based on the changes along with time in the temperature, humidity, and other facets of the internal environment of the heating units measured up until then, a predetermined amount of power starts to be supplied to the heating units in advance of the service start time by the predicted build-up time, the changes along with time in the internal environment from the start of supply of power to the heating heats up until when the print ready region is reached are measured and stored, and power starts to be supplied to the apparatus as a whole when the service start time is reached.

18 Claims, 22 Drawing Sheets

IMAGE FORMING APPARATUS CAPABLE OF CONTROLLING HEATING UNITS UNDER OPTIMUM DRIVING MODE AND A METHOD FOR CONTROLLING THE SAME

BACKGROUND OF THE INVENTION

1. Field of the Invention

The present invention relates to an image forming apparatus and a method for controlling the same, and more particularly, relates to an image forming apparatus including heating units for heating photosensitive drums, heat rollers, etc. and a method for controlling the same.

2. Description of the Related Art

As will be explained below in reference to the attached drawings, a conventional image forming apparatus is basically comprised of a power switch for instructing turning on and off of power, heating units for heating photosensitive drums, heat rollers, etc. and requiring power before printing, a machine unit provided with a conveyance system for paper, photosensitive drums, heat rollers, and various other mechanisms used for printing, and a power control unit for turning on or turning off the power based on the instruction from the power switch. The power control unit does not supply power to any unit other than the heating units, that is, the conveyance system and the rest of the machine unit, but continues to supply power to the heating units even when instructed to turn off power to the apparatus as a whole.

In the afore mentioned conventional image forming apparatus, power continues to be fed to the heating units throughout the night (all day) even after the power to the apparatus as a whole is turned off by the power switch. This is because the heating units have to heat drums or other objects with a larger calorific capacity and once the heat dissipates it takes time to return to the service temperature. This would mean an inability of immediate operation of the apparatus for printing and would be inconvenient to the user.

Accordingly, it is necessary to supply power throughout the night. Since the heating units are powered through the night, there have been safety problems and a large energy consumption.

On the other hand, when linking the turning on and off of power to the heating units with the turning on and off of power to the apparatus as a whole, it is necessary to turn on the power of the apparatus as a whole a predetermined time prior to one starting the printing in view of the time needed for the heating units to heat up the photosensitive drums. This means inconvenience in service due to the time gap between when the power is turned on and the time gap between when service may begin (Users generally want to be able to start using a machine right after they turn on the power.) Also, power is supplied to the apparatus as a whole, not only the heating units, during the warmup period. The power consumption is therefore that much larger compared to the situation in which power is supplied only to the heating units.

SUMMARY OF THE INVENTION

In consideration of the above problems, the present invention has as its object the provision of an image forming apparatus which does not continuously supply power to the heating units and is not linked with the input of power to the apparatus as a whole, but supplies power to the heating units by the choice of the user, and is easy to use, safe, and small in power consumption, and a method for controlling the same.

Further, the present invention has as its object the provision of an image forming apparatus which enables printing reliably at a set service start time, is easy to use, and is energy efficient.

To attain the above objects, the present invention is constituted so that one of the timed mode and continuous mode is selected and a time for beginning the supply of power to the heating units is input in the case of the selection of the timed mode, the selected mode is determined, the time until the set start of the supply of power is counted in the case of selection of the timed mode, and power starts to be supplied to the heating units when the time for starting the supply of power is reached after the power to the apparatus as a whole is turned off. When the continuous mode is selected, it directs power to be continued to be supplied to the heating units even after the power to the apparatus as a whole is turned off.

Further, the invention is constituted so that when the service start time is input, the next build-up time is predicted or the amount of power supplied to the heating units the previous time is modified based on the change along with time of the temperature, humidity, or other facets of the internal environment of the heating units measured up to the previous time, and a predetermined amount of power starts to be supplied to the heating units from the service start time to before the predicted build-up time and the changes over time of the internal environment from the start of the supply of power to the heating units until reaching the print ready region where printing is possible is measured and recorded, and power starts to be supplied to the apparatus as a whole when the service start time is reached.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Before describing the embodiments of the present invention, the related art and the disadvantages therein will be described with reference to the related figures.

Figure 1:
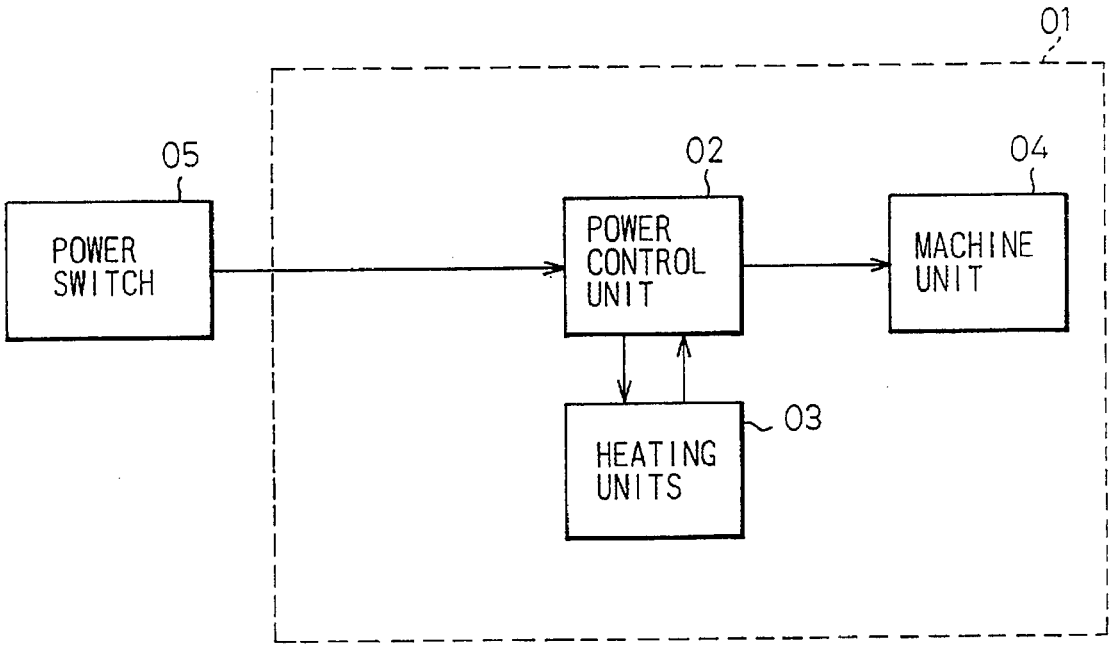
Fig.1 PRIOR ART
FIG. 1 is a view of the general configuration of a conventional image forming apparatus.

FIG. 1 is a view of the general configuration of a conventional image forming apparatus. In the past, as shown in FIG. 1, an image forming apparatus 91 was basically comprised of a power switch 05 for controlling the turning on and off of power, heating units 03 for heating photosensitive drums, heat rollers, etc. and requiring power before printing, a machine unit 04 provided with a conveyance system for paper, photosensitive drums, heat rollers, and various other mechanisms used for printing, and a power control unit 02 for turning on or turning off the power based on the instruction of the power switch 05, which unit does not supply power to any unit other than the heating units 03, that is, the conveyance system and the rest of the machine unit 04, but continues to supply power to the heating units 03 even when instructed to turn off power to the apparatus as a whole.

As mentioned earlier, power continues to be supplied to the heating units 03 throughout the night (throughout the day) even after the power to the apparatus as a whole is turned off by the power switch 05. This is because the heating units 03 have to heat drums and other objects with a large calorific capacity and once the heat dissipates it takes time to return to the service temperature. This would mean an inability of immediate operation of the apparatus for printing resulting in inconvenience to the user.

As a result, the previously mentioned problems are present. To solve these problems, the present invention has the following configuration.

Figure 2:
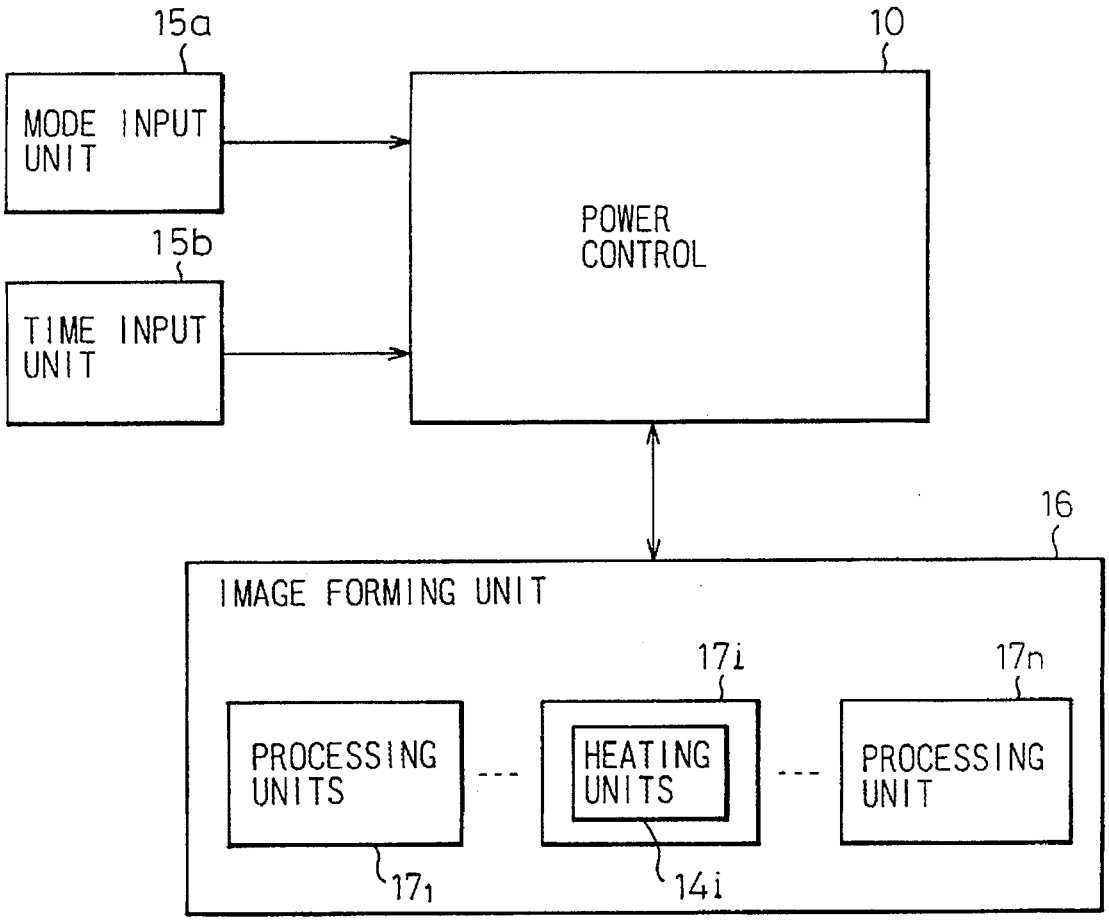
FIG. 2 is a view of the basic configuration of a first embodiment according to the present invention.

FIG. 2 is a view of the basic configuration of a first embodiment according to the present invention.

In the first embodiment, as shown in FIG. 2, provision is made of an image forming unit 16 having a plurality of processing units $\mathbf{17}_1$ to $\mathbf{17}_n$, heating units $\mathbf{14}_i$ (i being a natural number of 1, 2 . . . ) provided at least at one of the plurality of processing units $\mathbf{17}_1$ to $\mathbf{17}_n$, a mode input unit 15*a* for inputting one of the information of the continuous mode in which the heating operation of the heating units $\mathbf{14}_i$ is performed continuously and the information of the time mode in which the time of start of heating of the heating units is instructed, a time input unit 15*b* for inputting information showing the time of start of supply of power to the heating units in the time mode, and a power control means 10 for supplying power continuously to the heating units $\mathbf{14}_i$ when the mode information input from the mode input unit 15*a* is the continuous mode information and supplying and turning off power to the heating units $\mathbf{14}_i$ based on the information showing the time of start of the supply of power input from the time input unit 15*b* in the case where the mode information is the time mode information.

Here, a "heating unit" is for example a photosensitive drum heater used for heating a large calorific capacity photosensitive drum. To enable an apparatus with drums with such a large calorific capacity to be operated immediately after the power is turned on, it is necessary to supply power to warm up the drums in advance before the printing. Another object warmed up by the heating units other than the photosensitive drums is the fixing unit. The "time mode" means the mode for instructing the time for starting the heating by the heating units, that is, the mode for instructing the start of the supply of power to the heating units at a set time after the power is cut off. Since it "start(s) . . . the supply of power", the presumption is that the supply of power to the heating units $\mathbf{14}_i$ is turned off once in the timed mode. This is the point of difference with the "continuous mode", in which the supply of power to the heating units $\mathbf{14}_i$ is never turned off.

The "continuous mode" means the mode for continuously performing the heating operation, that is, the mode for continuously supplying power to the heating units $\mathbf{14}_i$ even after power to the apparatus as a whole is turned off.

Figure 3:
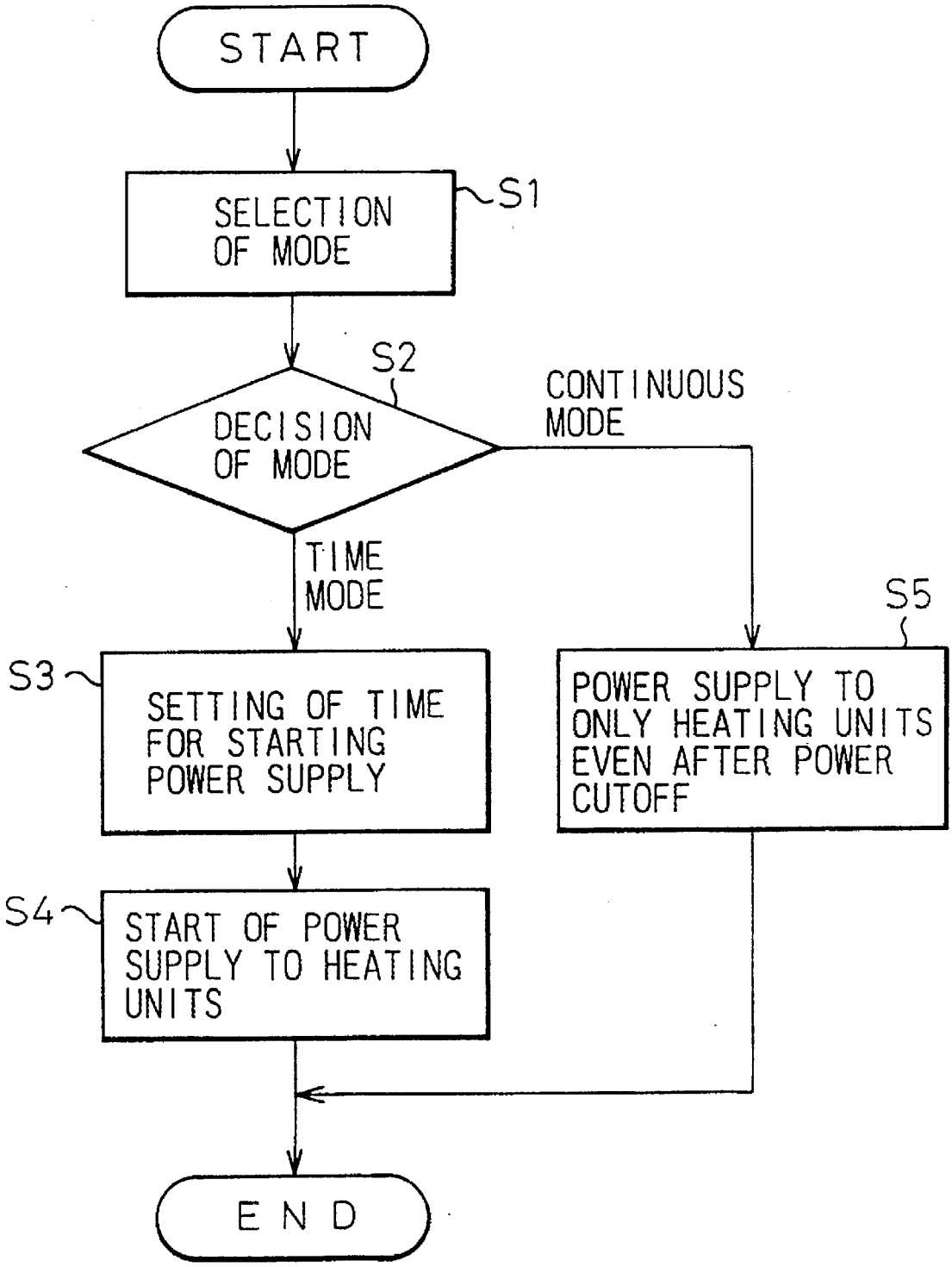
FIG. 3 is a flow chart of the method of the present invention relating to the configuration of FIG. 2.

FIG. 3 is a flow chart of the method of the present invention relating to the configuration of FIG. 2.

As shown in FIG. 3, the method of the present invention consists of controlling an image forming apparatus having heating units so that one of the timed mode and continuous mode is selected and a time for start of supply of power to the heating units is input in the case of the selection of the timed mode (S1), the selected mode is determined (S2), the time until the set start of supply of power is counted in the case of selection of the time mode (S3), and power starts to be supplied to the heating units when the set time for starting the supply of power is reached after the power to the apparatus as a whole is turned off (S4). When the continuous mode is selected, it instructs that power continue to be supplied to the heating units even after the power to the apparatus as a whole is turned off (S5).

Figure 4:
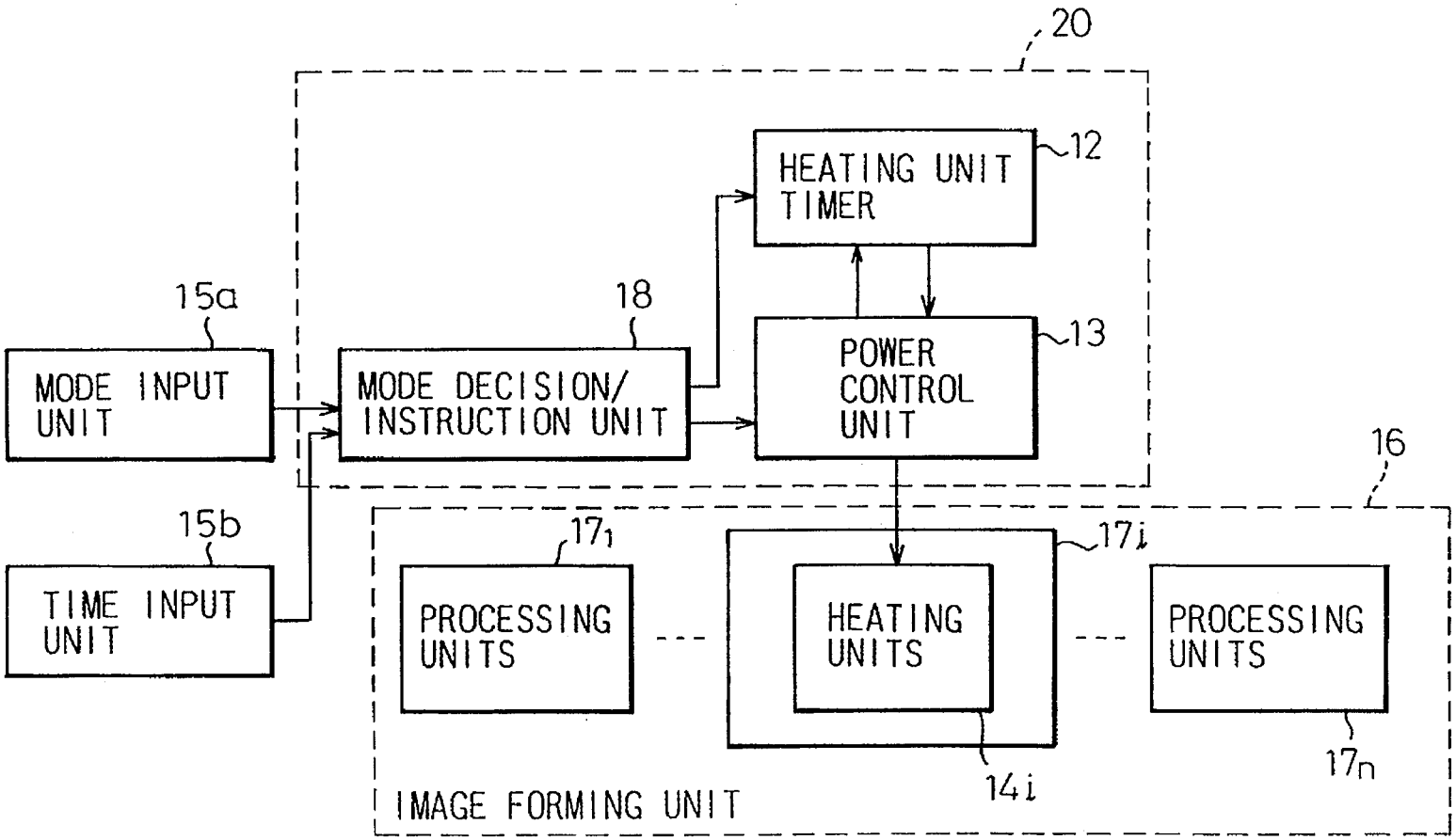
FIG. 4 is a block diagram of a first specific example of the first embodiment.

FIG. 4 is a block diagram of a first specific example of the first embodiment. As shown in FIG. 4, the power control means 20 is provided with a mode decision/instruction unit 18 for determining the input mode, setting the time for start of the supply of power in a heating unit timer 12 in the case of selection of the timed mode, and instructing the continuation of the supply of power to the heating units $\mathbf{14}_i$ in the case of turning of power to a power control unit 13 in the case of selection of the continuous mode, a heating unit timer 12 for counting the time until the start of the supply of power and instructing the start of supply of power to the power control unit 13 when the time for start of the supply of power has been reached, and a power control unit 13 for supplying power to or turning power off from the various circuits when instructed to input or cut off power, starting the supply of power to the heating units $\mathbf{14}_i$ when instructed to start the supply of power by the heating unit timer 12, and continuing the supply of power to the heating units 14 when instructed to continue the supply of power to the heating units $\mathbf{14}_i$ even after turning off of power to the apparatus as a whole in the case of an instruction to continue the power supply by the mode decision/instruction unit 18.

Further, when the same power source is used for the heating unit timer 12 as the other circuits of the image forming apparatus, power is supplied from the power control means 20 even after the turning off of power to the apparatus as a whole.

Figure 5:
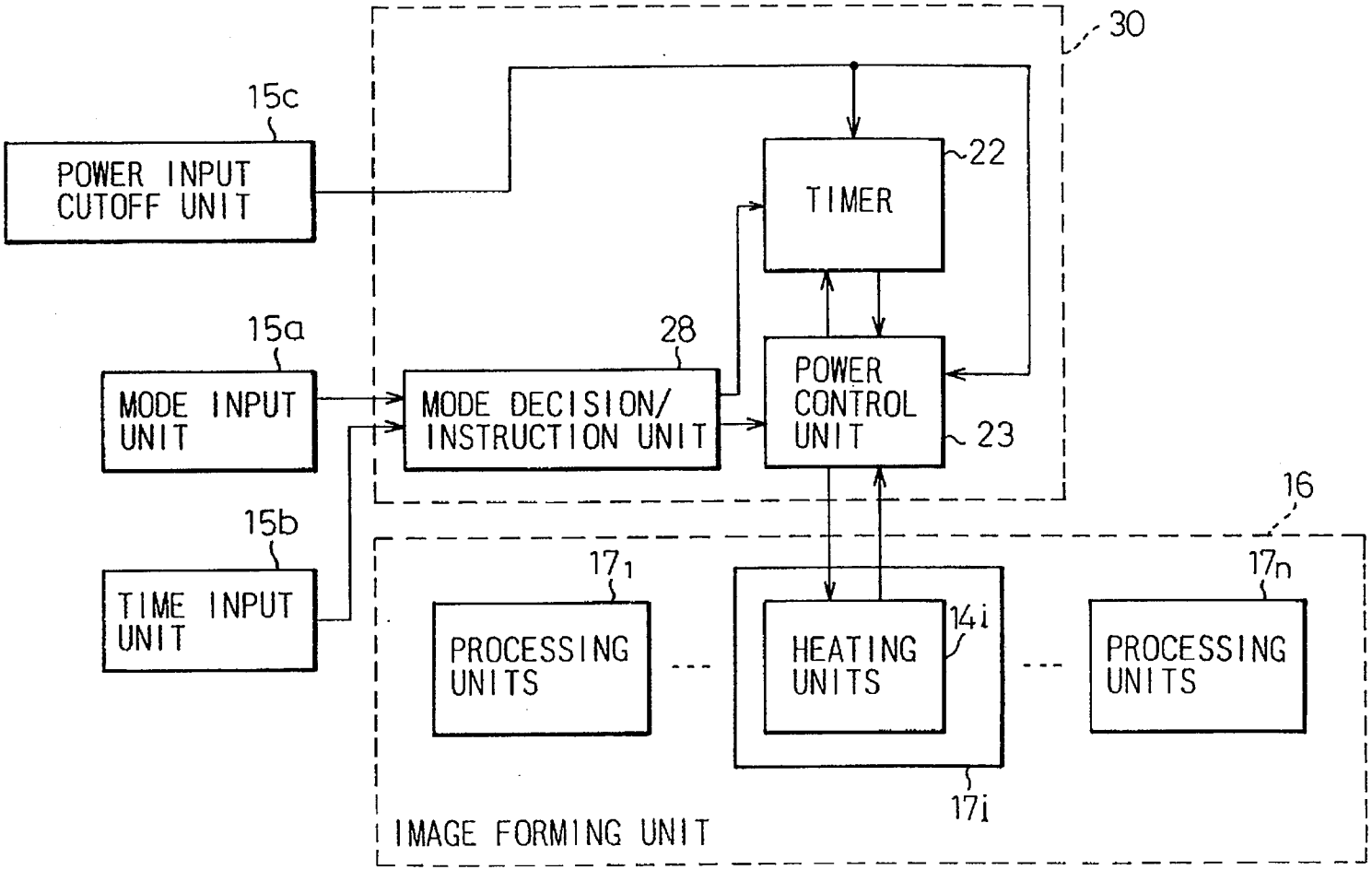
FIG. 5 is a block diagram of a second specific example of the first embodiment.

FIG. 5 is a block diagram of a second specific example of the first embodiment.

As shown in FIG. 5, provision is made for a power input/cutoff unit 15*c* for instructing input or turn off of power or instructing input or turnoff of power at a set time. Further, the power control means 30 is provided with a mode decision/instruction unit 28 for determining the selected mode, setting the time for start of the supply of power in the timer 22 in the case of the selection of the timed mode, and instructing the continuation of the supply of power to the heating units $\mathbf{14}_i$ in the case of cutoff of power to the power control unit 13 the continuous mode is selected.

Further, the power control means 30 is provided with a timer 22 for measuring the set time for the start of the supply of power and instructing the start of the power supply to the power control unit 23 when the time for start of the supply of power has been reached and for counting the time set by the power input/cutoff unit 15*c* and instructing the input or turn off of power to the power control unit 23 when the time has been reached and a power control unit 23 for supplying power to or turning off power from the various circuits when instructed to input or turn off power by the timer 22 or the power input/cutoff unit 15*c*, starting the supply of power to the heating units $\mathbf{14}_i$ when instructed to start the supply of power by the timer 22, and continuing the supply of power to the heating units $\mathbf{14}_i$ even when power to the apparatus as a whole has been turned off when instructed to continue the power supply by the mode decision/ instruction unit 28.

Further, the power input/cutoff unit 15*c* inputs and turns off power to and from the apparatus as a whole. This is different from the timed mode where the power for just the heating units 14i is supplied or turned off and from the continuous mode.

Figure 6:
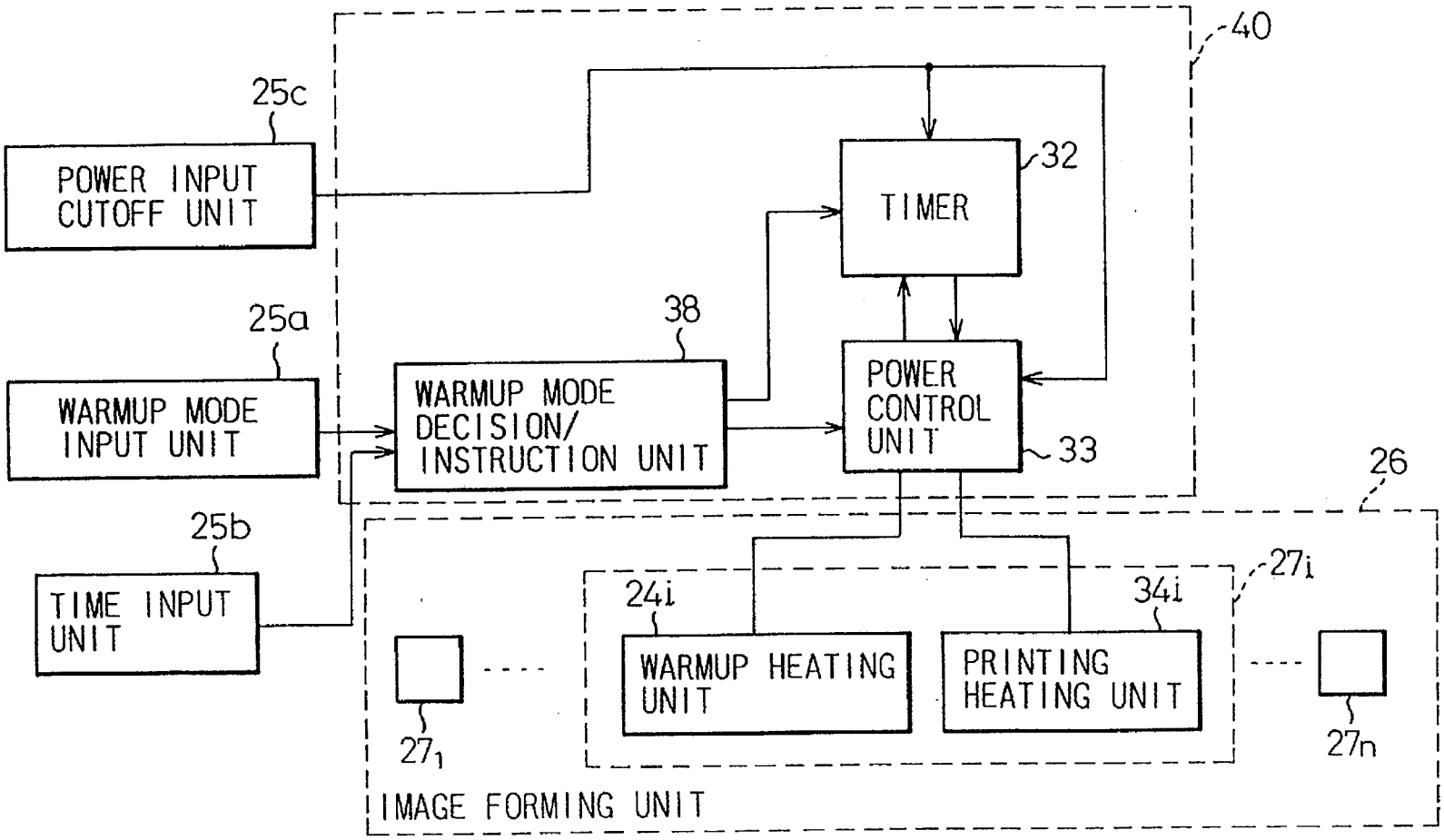
FIG. 6 is a block diagram of a third specific example of the first embodiment.

FIG. 6 is a block diagram of a third specific example of the first embodiment. As shown in FIG. 6, a provision is made of an image forming unit 26 having a plurality of processing units $\mathbf{27}_i$ to $\mathbf{27}_n$, warmup heating units 24i used at the time of warmup and provided at least at one of the plurality of processing units 271 to $\mathbf{27}_n$, and printing heating units $\mathbf{34}_i$ used at the time of printing. Further, provision is made of a power input/cutoff unit 25*c* for instructing the input or turn off of power or instructing turning on and off of power at a set time, a warmup mode input unit 25*a* for inputting one of information of a continuous mode for having the warmup heating units $\mathbf{24}_i$ continuously perform their heating operation and information of a time mode for instructing the time for start of the heating by the heating units, a time input unit 25*b* for inputting information showing the time for start of the supply of power to the heating units in the time mode, and a power control unit 40.

The power control means 40 is provided with a warmup mode decision/instruction unit 38 for determining the selected mode, setting the time for start of the supply of power in the timer 32 in the case of the selection of the timed mode, and instructing the continuation of the supply of power to the warmup heating units $\mathbf{24}_i$ when turning off power to the power control unit 33 in the case of selection of the continuous mode and a timer 32 for measuring the set time for start of the supply of power, instructing the start of the supply of power to the power control unit 33 when the time for starting the power supply is reached and also counting the time set by the power input/cutoff unit 25*c* and instructing the input or turnoff of power to the power control unit 33 when that time has been reached.

Further, the power control means 40 is provided with a power control unit 33 for changing over the supply of power from the warmup heating units $\mathbf{24}_i$ to the printing heating units $\mathbf{34}_i$ and starting the supply of power to other circuits when instructed to input power by the timer 32 or the power input/cutoff unit 25*c*, turning off power to the circuits when instructed to turn off power by the timer 32 or the power input/cutoff unit 25*c*, starting the supply of power to the warmup heating units $\mathbf{24}_i$ when instructed to start the supply of power by the timer 32, and continuing the supply of power to the warmup heating units $\mathbf{24}_i$ even after the turn off of power to the apparatus as a whole when instructed to continue the supply of power by the warmup mode decision/ instruction unit 38.

Here, the warmup heating units $\mathbf{24}_i$ warm the image forming unit at the time of warmup. The printing heating units $\mathbf{34}_i$ warm this at the time of actual printing. The temperature of the warmup heating units $\mathbf{24}_i$ may be generally lower than the temperature required at the time of printing, so setting it lower than the temperature of the printing heating units $\mathbf{34}_i$ can be of use in reducing the power consumption.

The operation of the embodiment shown in FIG. 2 will be explained next while referring to FIG. 3.

At step S1, information showing either of the continuous mode or timed mode is input from the mode input unit 15*a*.

When information showing the timed mode is input from the mode input unit 15*a*, the time that the power is to be supplied to the heating units $\mathbf{14}_i$ (to start the power supply) is input from the time input unit 15*b*.

This being done, at step S2, the power control means determines the mode which was input. When this is the continuous mode, at step S5, it supplies power to only the heating units even after power has been turned off to the apparatus as a whole. When it is the timed mode, at step S3, it measures the time until the start of the supply of power and, at step S4, starts the supply of power to the heating units when the time for starting the supply of power has been reached.

Here, the timed mode and the continuous mode designate the cutoff or supply of power to the heating units 14. This differs from the input or turn off of power to the apparatus as a whole.

In the first specific example shown in FIG. 4, the mode decision/instruction unit 18 determines if the mode selected by the mode input unit 15*a* is the timed mode or the continuous mode.

When the mode decision/instruction unit 18 determines it is the timed mode, the timed for the start of the supply of power input by the time input unit 15*b* is set in the heating unit timer 12 etc.

Further, when the time for the start of the supply of power arrives after the turn off of power to the apparatus as a whole, the power control unit 13 starts the supply of power to the heating units $\mathbf{14}_i$ and the heating units $\mathbf{14}_i$ enter a heating state. After this state is reached, power is input by instruction, for example, from the operator, host computer, floppy disk drive, etc.

On the other hand, when the mode decision/instruction unit 18 determines that it is the continuous mode, when the power has been turned off to the apparatus, the power control unit 14 maintains its supply of power to the heating units $\mathbf{14}_i$.

In the second specific example shown in FIG. 5, provision is made for a power input/cutoff unit 15*c* for inputting and turning off of power to the apparatus as a whole. The timer 22 is designed to be able to set the time for the start of the supply of power to the heating units $14_i$ and also to set the time of inputting or turning off the power of the apparatus as a whole. By this, it is made possible to automatically set the time for input and turn off of power not only to the heating units $14_i$, but also the entire apparatus.

In the third specific example shown in FIG. 6, provision is made of warmup heating units $24_i$ and printing heating units $34_i$ for making the amounts of heat at the time of warmup and printing different. This enables a further reduction in the amount of heat consumed at the time of warmup.

Figure 7:
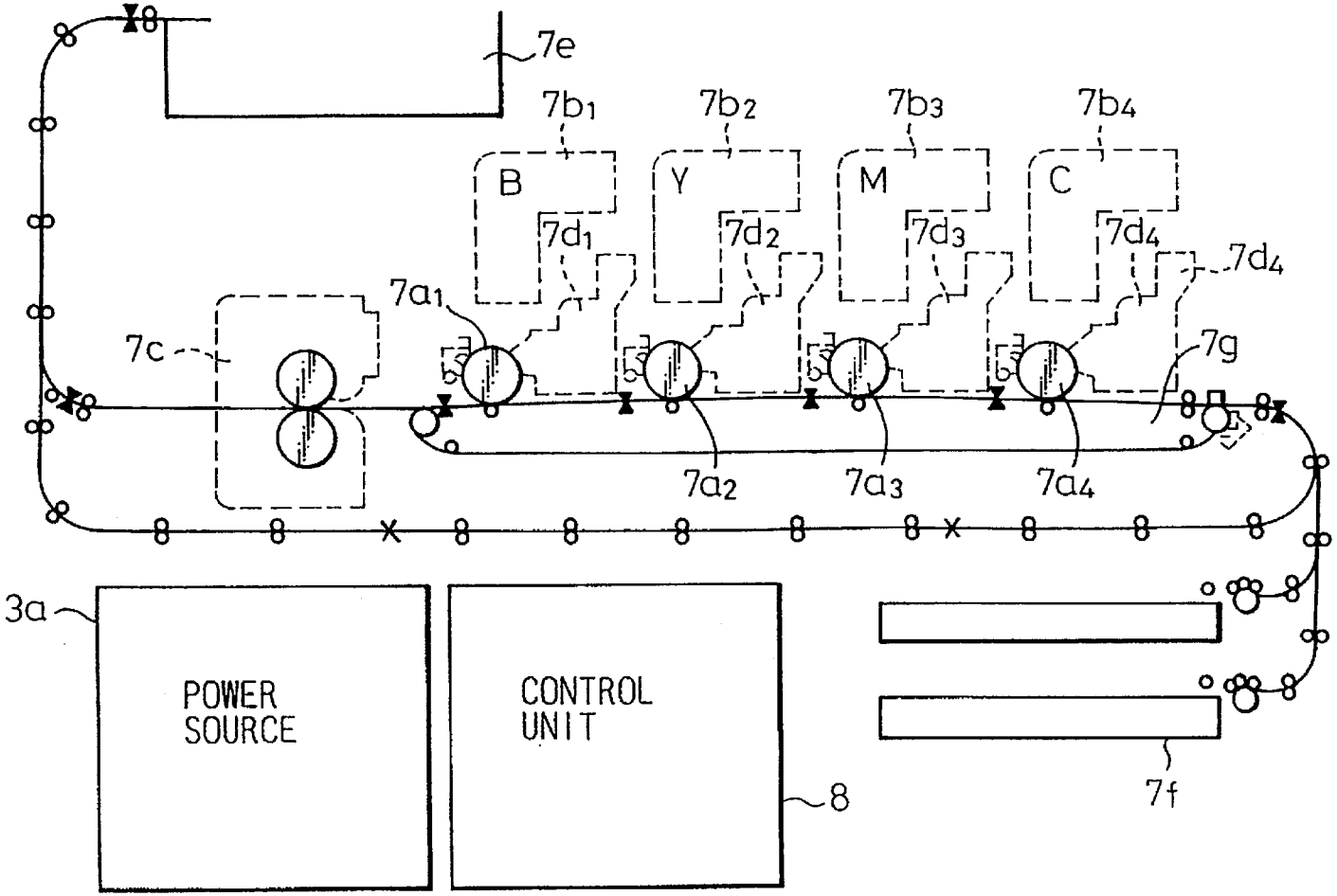
FIG. 7 is a view of the general configuration of an image forming apparatus to which the first embodiment is applied.

FIG. 7 is a view of the general configuration of an image forming apparatus to which the first embodiment is applied. In particular, it shows the general configuration of a printing apparatus used as the image forming apparatus, more particularly, a printing mechanism (71 in FIGS. 9 and 11) of a color printing apparatus used as a printing apparatus. As shown in the figure, this apparatus is provided with four printing drums $7a_1$ to $7a_4$ for the three primary colors (Y: yellow, M: magenta, and C: cyan) and black (B: black) as the objects to be heated, a fixing unit comprised of heat rollers and backup rollers as other objects to be heated, four optical systems $7b_1$ to $7b_4$provided for the colors in the same way as the four color drums $7a_1$ to $7a_4$, four developers $7d_1$ to $7d_4$ similarly provided for the different colors, a tray 7e and hopper 7f for carrying the paper, an electrostatic attraction belt 7g for conveying the paper, a power source 3a for supplying power to the apparatuses of the printing apparatus, and a control unit 8 for performing various types of control relating to the printing apparatus.

Figure 8:
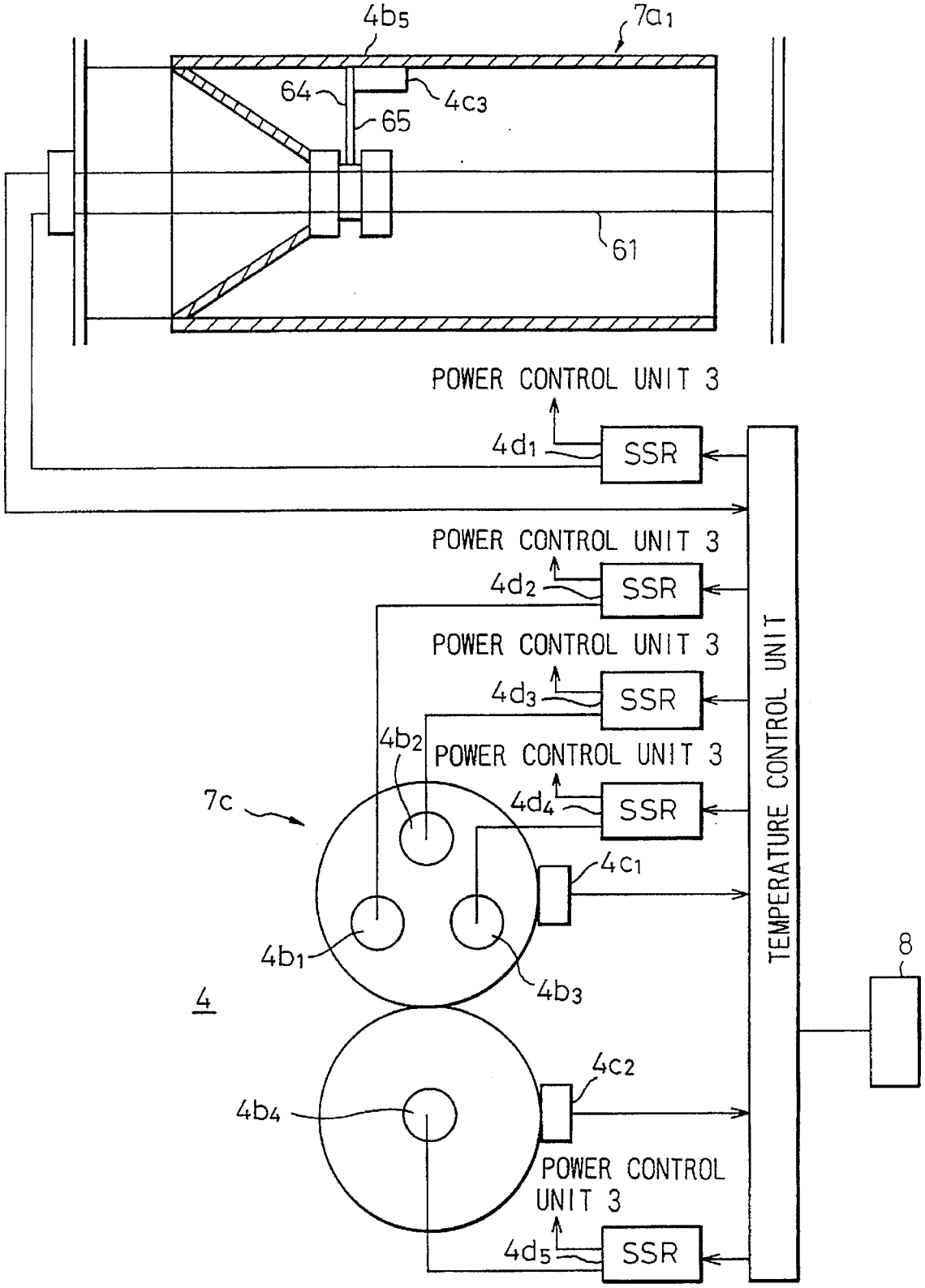
FIG. 8 is a detailed view showing enlargements of a pair of a heating unit and heated object in FIG. 7.

FIG. 8 is a detailed view showing enlargements of a pair of a heating unit and heated object in FIG. 7.

The printing apparatus of FIG. 7 is provided with processing units for the four colors (Y: yellow, M: magenta, C: cyan, and B: black), fixing processing units, and other processing units. FIG. 8 shows the heating unit 4 for the drum $7a_1$ provided at one color processing unit and the fixing unit 7c for the fixing processing unit.

The heating unit 4 ($4b_3$, $4c_3$) is provided for the drum $7a_1$ so as to prevent a reduction of the printing quality and to ensure stable printing (the same for the drums $7a_2$ to $7a_4$ provided at the other color processing units). The heating unit 4 ($4b_1$ to $4b_4$) is provided for the fixing unit 7c because it is necessary to heat the fusible toner to fix the toner transferred to the paper. A certain build-up time is required until the heating unit 4 heats the large calorific capacity drum $7a_1$ etc. and the desired temperature is reached.

A heating unit 4 is provided with a temperature control unit 4a and various heaters $4b_1$ to $4b_5$. As shown in FIG. 8, the heaters $4b_1$ to $4b_4$ are halogen lamps for the fixing unit 7c to be warmed. The heater $4b_5$ is a heater for the drum $7a_1$ to be warmed. As shown in FIG. 8, the surface of the drum $7a_1$ corresponds to the heater $4b_5$ for heating by passing a large current. The drum surface is further provided with a thermistor $4c_3$. Further, the current line 64 is connected with the drum surface to supply the large current to the surface. The signal line 65 is for transmitting the signals from the thermistor $4c_3$ and is connected through the inside of the drum shaft 61 and through the SSR's (solid state relays) (with circuit switching part of the relay replaced with semiconductor elements for elimination of contacts) $4d_1$ to $4d_5$ to the power control unit 3 or the temperature control unit 4a.

Further, the fixing unit 7c is provided with heaters $4b_1$ to $4b_4$ and thermistors $4c_1$ to $4c_2$. The heaters $4b_1$ to $4b_4$ are connected with the power control unit 3 through SSR's (4d). The thermistors $4c_1$ to $4c_2$ are connected with the temperature control unit 4a. In the case of the fixing unit 7c, halogen lamps are used for the heaters $4b_1$ to $4b_4$ as mentioned above.

Figure 9:
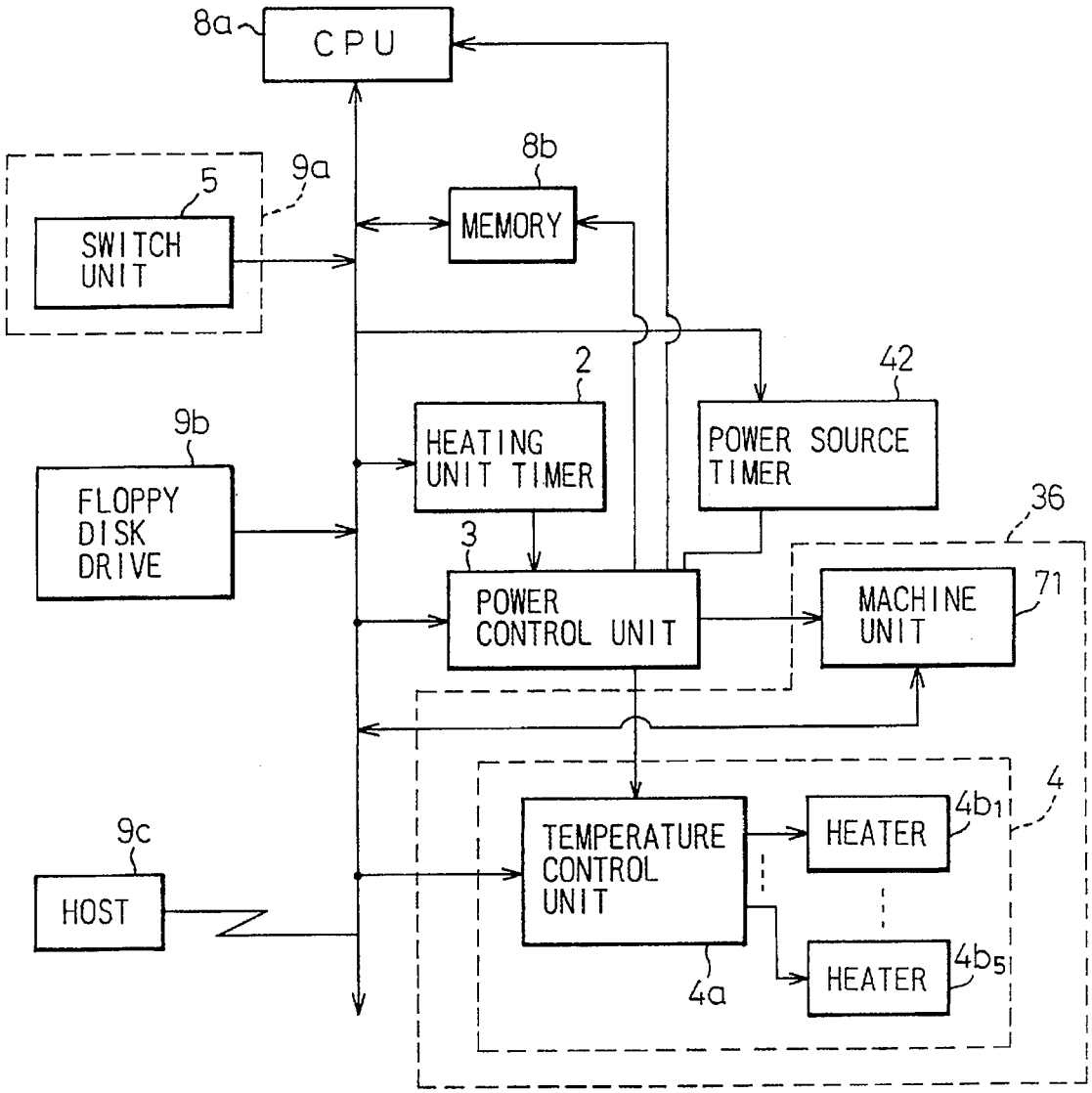
FIG. 9 is a block diagram of the system configuration corresponding to the first and second specific examples.

FIG. 9 is a block diagram of the system configuration corresponding to the first and second specific examples. The printing apparatus shown in FIG. 9 is provided with a switch unit 5 on an operator panel 9a, for instructing the input or turn off of power, inputting one of the information showing the timed mode or continuous mode, or inputting the time for starting the supply of power or the time for input/cutoff of power, and a floppy disk drive 9b.

The printing apparatus is further connected to a host computer 9c through an interface circuit, not shown, and forms the image on the paper in accordance with the image information for printing given from the host computer 9c.

The switch unit 5 is provided for the operator to input the mode information, input the time, input the power, or cut off the power. The floppy disk drive 9b and the host computer 9c are used for the automatic input of the mode, input of the time, and input or turn off of power by a program without intervention by an operator.

Here, the "timed mode" and "continuous mode" have the same meaning as explained above.

Further, provision is made for a CPU 8a for performing various types of control for the printing apparatus, a memory 8b in which the program etc. are stored, a machine unit 71 provided with various printing mechanisms, such as the drums $7a_1$ to $7a_4$ and the optical systems $7b_1$ to $7b_4$, heating units 4 requiring supply of power from before the time of printing, a heating unit timer 2 counting the time until the start of the power supply set for the heating units 4 and for instructing the start of the supply of power to the power control unit 3 when the time for the start of supply of power has been reached, a power source timer 42 for counting the time set for the power supply of the apparatus and instructing turning on and off of power to the power control unit 3 when the time has been reached, and a power control unit 3 for performing various types of control relating to the power source.

Here, the CPU 8 and memory 8b have functional means corresponding to the mode decision/instruction unit 18 for determination if the selected mode is the time mode or continuous mode, for setting the time for the start of the supply of power in the heating unit timer 2 when the timed mode has been selected, and for instructing the power control unit 3 to continue the supply of power to the heating unit 4 when turning off power to the apparatus as a whole when the continuous mode has been selected.

Further, the heating unit timer 2, upon instruction from the CPU 8a, counts the set time until the start of supply of power and instructs the power control unit 3 to start the supply of power to the heating units 4 when the time for the start of supply of power has been reached. The power source timer 42 counts the time set by the switch unit 5 and instructs the input or turn off of power to the power control unit 3 when the time has been reached.

The power control unit 3 at least supplies power to or cuts power off from the circuits when instructed to input power or turn off power by the power source timer 42 or switch unit 5, starts the supply of power to the heating units 4 when instructed to start the supply of power by the heating unit timer 2 (time mode), or continue the supply of power to the heating units 4 even after power to the apparatus as a whole has been turned off when instructed to continue supplying power by the CPU 8a (continuous mode).

In FIG. 9, further, the machine unit 71 and heating unit 4 constitute the image forming unit (36); while the CPU 8a, memory 8b, heating unit timer 2, power source timer 42, and power control unit 3 constitute the power control means 10, which corresponds to the control unit 8 of FIG. 8.

Figure 10A:
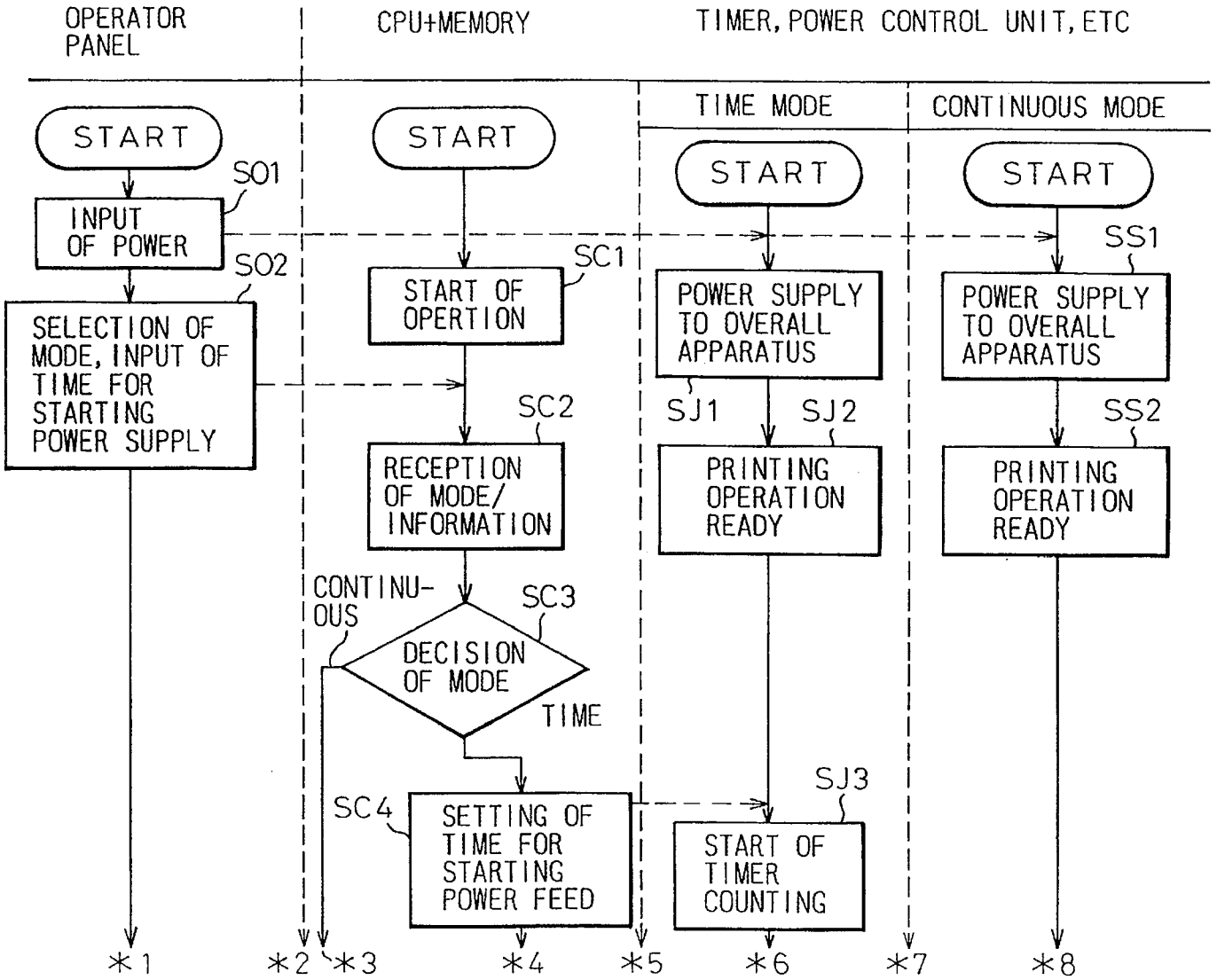
FIGS. 10A and 10B are flow charts for explaining the operation in the system shown in FIG. 9.
Figure 10B:
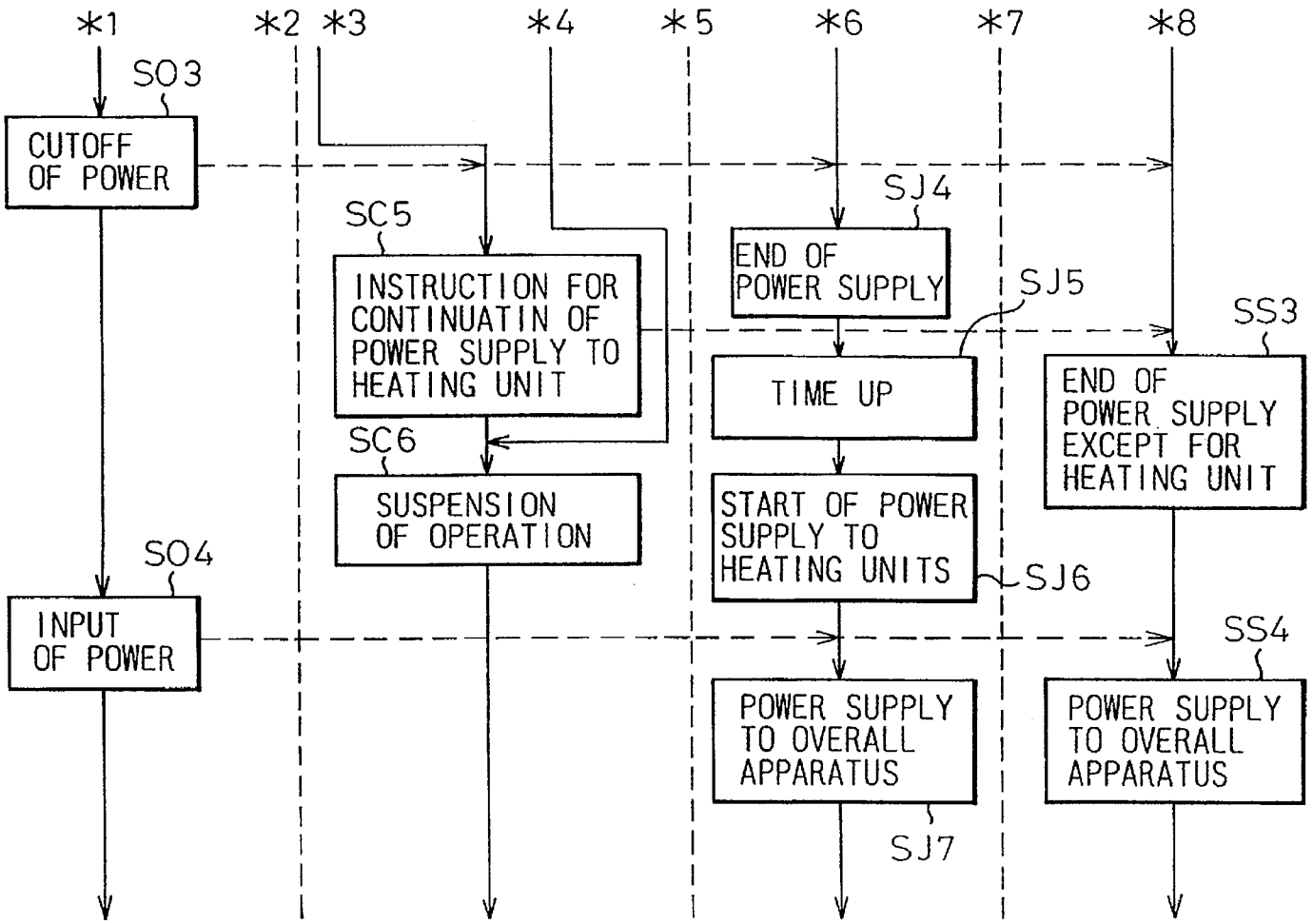

FIGS. 10A and 10B are flow charts for explaining the operation in the system shown in FIG. 9.

As shown in FIGS. 10A and 10B, at step SO1, when instructed to input power by the switch unit 5 provided on the operator panel 9a, the CPU 8a and the memory 8b start to operate. At step SJ1 (when selecting the time mode) or step SS1 (when selecting the continuous mode), power is supplied to the printing apparatus as a whole by the power control unit 3.

As a result, at step SJ2 or step SS2, the printing apparatus becomes able to perform a printing operation.

At step SO2, the operator selects the timed mode or the continuous mode by the switch unit 5 of the operator panel 9a.

When the time mode is selected, the operator is prompted by the display etc. to input the time for the start of supply of power for supplying power to the heating units 4. When, for example, setting 6:00 AM of the next day, the operator inputs the corresponding figures from the switch unit 5 as 1 day later 6:00. In this way, the operator inputs the time for start of supply of power from the switch unit 5 of the operator panel.

The information selected or set by the operator is sent to the CPU 8a and received at step SC2. Using the CPU 8a and the program stored in the memory 8b, the selected mode is determined at step SC3. If it is determined that the selected mode is the timed mode, the routine proceeds to step SC4, where the CPU 8a sets the time for start of the power supply input to the heating unit timer 2.

When the time for start of the power supply is set from the CPU 8a, at step SJ3, the heating unit timer 2 starts counting the time.

Next, when there is an instruction for cutoff of power at step SO3 from the switch unit 5 of the operator panel 9a, at step SJ4 the power control unit 3 turns off the power to all circuits of the image forming apparatus, including the heating units 4, except for the power for driving the heating unit timer 2, when necessary. Accordingly, the CPU 8a and the memory 8b are also stopped from operating at step SC6.

After the end of the power supply, at step SJ5, the heating unit timer 2 counts the set time. When counting it, at step SJ6, the heating unit timer 2 instructs the power control unit 3 to supply power to only the heating units 4. By this, the warmup of the printing apparatus is started.

Next, when there is an instruction for input of power from the switch unit 5 of the operator panel 9a at step SO4, the power control unit 3 supplies power to all circuits of the apparatus, not just the heating units 4 at step SJ7 and then returns to the stage of step SJ1. The printing operation is then enabled.

Next, an explanation will be made of the case of selection of the continuous mode by the switch unit 5 at step SO2.

In this case too, the selected information is received and is fetched into the CPU 8a at step SC2. At step SC3, the mode is determined.

In the case of the continuous mode, when there is then an instruction for turning off the power from the switch unit 5 of the operator panel 9a at step SO3, the CPU 8a instructs the power control unit 3 to continue supplying power to just the heating units 4 at step SC5.

This being done, the power control unit 3 ends the supply of power to the other circuits, except for the power to the heating units 4, at step SS3.

Next, when there is an instruction to input power from the switch unit 5 at step SO4, the power control unit 3 supplies power to the apparatus as a whole. The routine then returns to step SS1, whereupon the printing operation is enabled.

As explained above, power is supplied to the heating units by selection of the time mode or continuous mode, in accordance with the situation and desire of the user. Accordingly, compared with supplying power continuously to the heating units, it is possible to reduce the energy consumption.

The continuous mode is selected, when for example, when the time for operation of the apparatus is not fixed and it is impossible to set the timer.

In particular, when a printing apparatus is used as the output device connected to a host computer, when the host computer operates throughout the night, an all night mode is required. Further, there are various operation modes for the host computer and these must all be dealt with. In this embodiment, it is made possible to provide a printing apparatus which can handle the various operation modes of the host computer.

Figure 11:
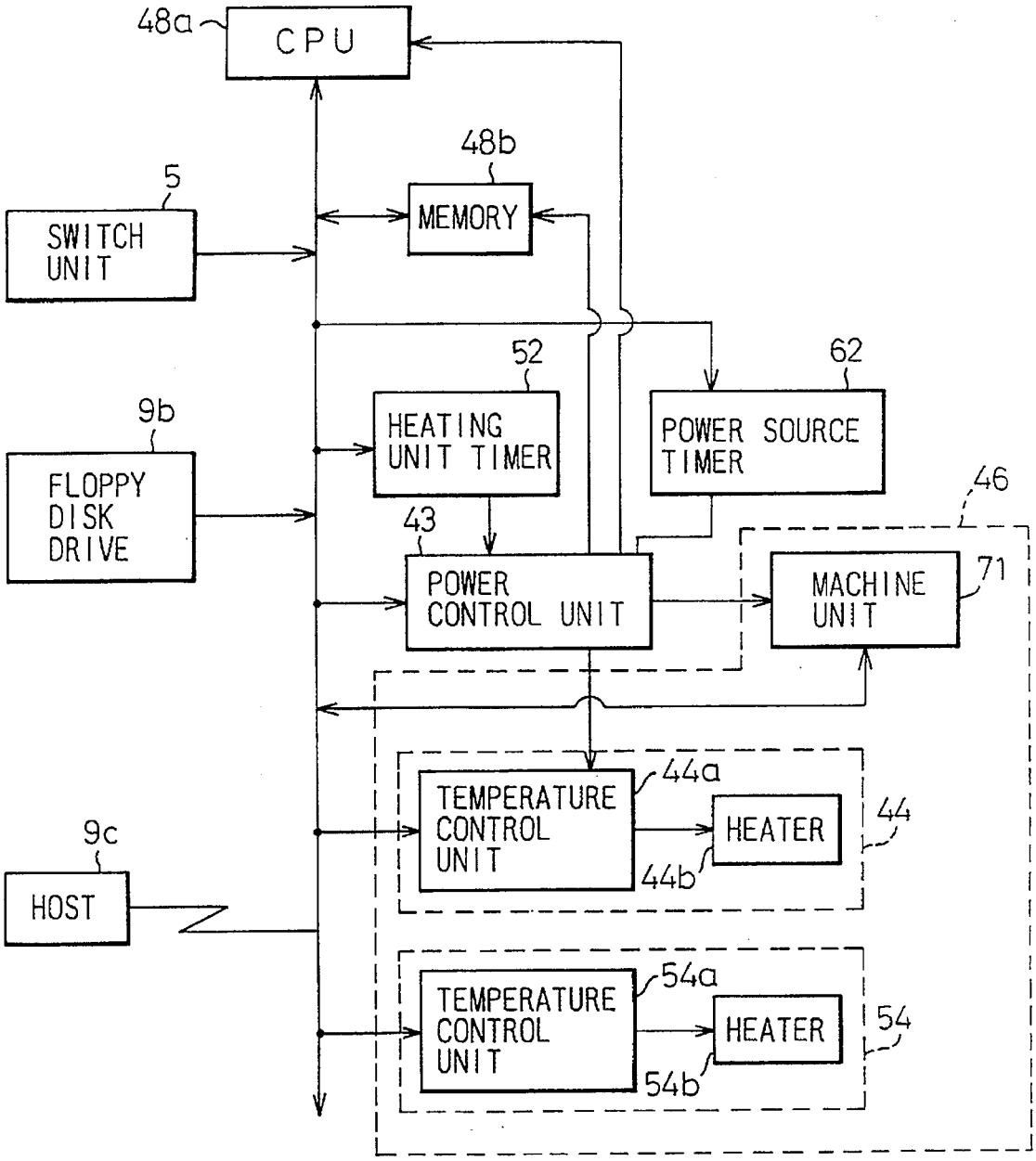
FIG. 11 is a block diagram of the system configuration corresponding to the third specific example.

FIG. 11 is a block diagram of the system configuration corresponding to the third specific example.

In the configuration of this figure, unlike in the case of FIG. 9, warmup heating units 44 for use at the time of warmup and printing heating units 54 for use at the time of printing are provided independently instead of the heating units 4.

The warmup heating units 44 and the printing heating units 54 are separated in this way because the temperature setting may be made lower in the case of warmup compared with general printing.

Further, due to this difference, unlike the case of FIG. 9, a CPU 48a and memory 48b are provided instead of the CPU 8a and memory 8b, a heating unit timer 52 is provided instead of the heating unit timer 2, and a power control unit 43 is provided instead of the power control unit 3.

Also, provision is made of a CPU 48a and memory 48b for forming the warmup mode decision/instruction unit for determining the selected mode, setting in the heating unit timer 52 the time for the start of supply of power to the warmup heating units 44 in the case of the time mode, and instructing the power control unit 43 to continue the supply of power to the warmup heating units 44 when turning off power to the apparatus as a whole in the case of the continuous mode and a heating unit timer 52 for counting the time set under instruction of the CPU 48a and instructing the power control unit 43 to supply power to the warmup heating units 44 when the time for starting the supply of power has been reached.

Further, provision is made of a power source timer 62 for counting the time set under instruction from the switch unit 5 and instructing the input or turn off of power when the time has been reached and a power control unit 43 for supplying power to the warmup heating units 44 based on an instruction from the heating unit timer 52 or CPU 48a, switching the supply of power from the warmup heating units 44 to the printing heating units 54 and supplying power to other circuits based on an instruction for inputting power from the power source timer 62 or switch unit 5, and turning the power to all circuits except the heating unit timer 52 or warmup heating units 44 based on an instruction for turning off power from the power source timer 62 or switch unit 5.

In the case of FIG. 11, when selecting the timed mode or the continuous mode, power is supplied to the warmup heating units 44 from the set time or throughout the night, while when power is input by the switch unit 5, power is supplied switched from the warmup heating units 44 to the printing heating units 54 by the power control unit 4.

Accordingly, according to the configuration of this figure, the amount of heat can be reduced in the case of warmup compared with printing, so the energy consumption can be cut further compared with the case of FIG. 9.

In the configuration of FIG. 11, use was made of the warmup heating units 44 and printing heating units 54 as the heating units, but it is also possible to provide a plurality of similar heating units and specify the number used for generating heat for the warmup and printing instead.

In this case, when performing the warmup, the number specified becomes smaller than the number in the case of printing. Further, when having to perform printing in a hurry, it is possible to increase the number specified compared to normal circumstances.

In addition, in the above embodiment, the heating unit timer and power source timer were provided separately, but it is also possible to combine the two. Further, it is also possible to eliminate the power source timer.

Also, in the above-mentioned embodiment, the operator selected the mode and input the time for starting the power supply etc., but it is also possible to provide automatic instructions without advance setting of the power cutoff each time by setting the timer in 24-hour units, that is, day units, to facilitate management or setting a round number of days, for example, a week or month, by instruction from a host computer or by instruction written in a floppy disk in a floppy disk drive.

Note that the "image forming apparatus" of the present invention includes not only a color printing apparatus, but also a monochromatic printing apparatus, of course, and further a color copier, electronic photography type printing apparatus, monochromatic copier, and facsimile apparatus.

In the above example, further, the explanation was made of heating units provided for some of the processing units of the plurality of processing units provided in the image forming unit of the printing apparatus, but the above explanation similarly applies to other processing units provided with heating units.

As explained above, in the first embodiment of the present invention, the heating units of the image forming apparatus are not continuously supplied with power and the input of power to the apparatus as a whole and the supply of power to the heating units are not linked. Power is supplied to the heating units independently from the input of power to the apparatus as a whole. Also, the timed mode or continuous mode may be selected for the supply of power to the heating units in accordance with the user's situation. Further, it is possible to save power at the time of warmup.

Therefore, compared with the case of continuous supply of power to the heating units or the case of linking the power supply to the heating units with the input of power to the apparatus as a whole, it is possible to provide an easy-to-use image forming apparatus which enables immediate use upon input of power without a noticeable preparatory time of the heating units, and a method of control of the same, by having the user select the optimal mode in accordance with the state of use, such as the operating schedule of the computer connected to the image forming apparatus or the planned use by the user.

Further, it is possible to provide an image forming apparatus which is safe and consumes little energy by saving power at the time of warmup and a method for control of the same.

Next, a second embodiment of the present invention will be explained.

Figure 12:
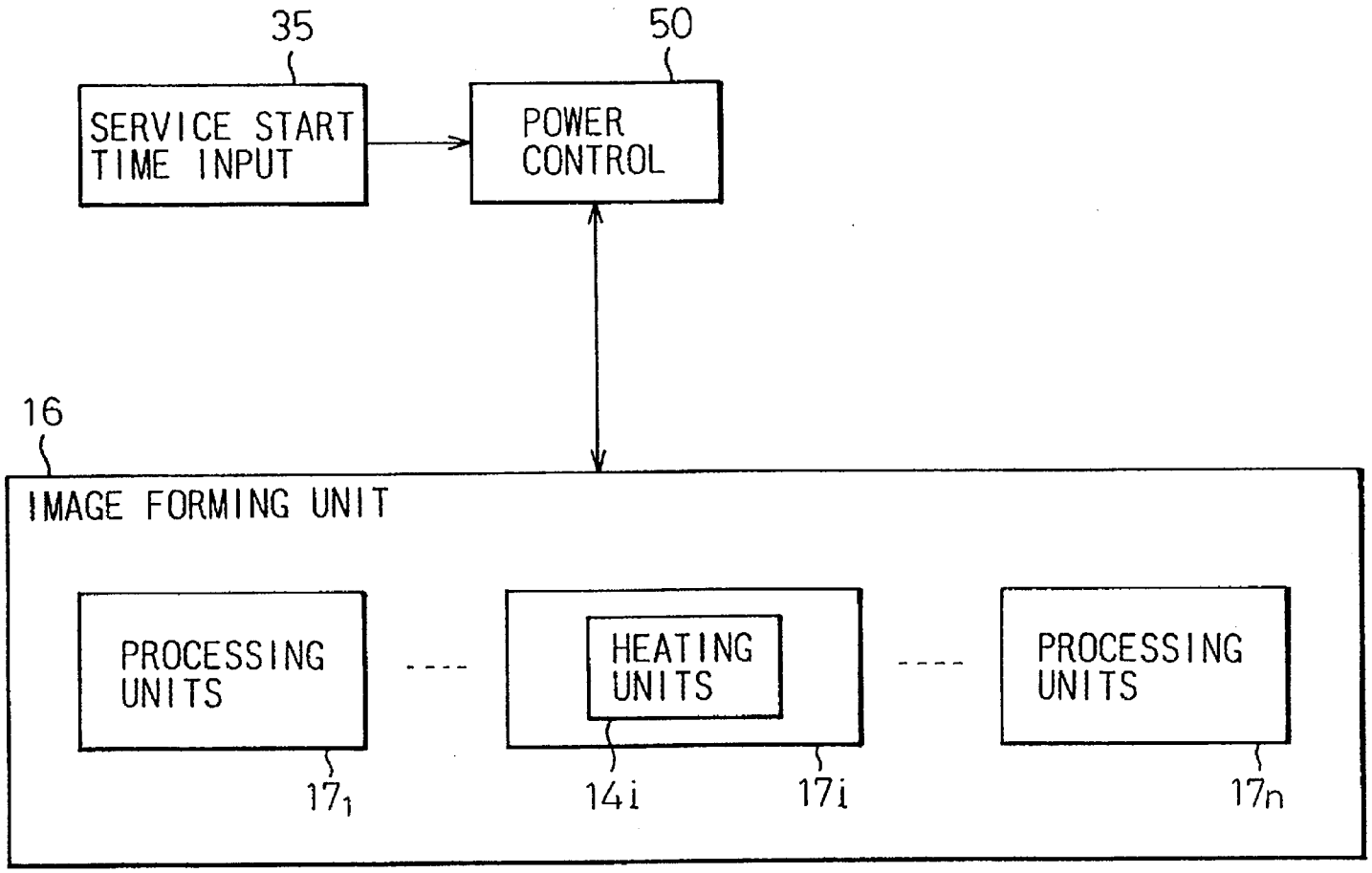
FIG. 12 is a view of a prototype of a second embodiment based on the first embodiment (FIG. 2)

FIG. 12 is a view of the basic form of a second embodiment based on the first embodiment (FIG. 2). The image forming apparatus of the configuration of this figure is provided with an image forming unit 16 having a plurality of processing units $\mathbf{17}_1$ to $\mathbf{17}_n$, heating units $\mathbf{14}_i$ (i being a natural number of 1, 2 . . . ) provided at least at one of the plurality of processing units $\mathbf{17}_1$ to $\mathbf{17}_n$, a service start time input unit 35 for inputting the service start time at which use of the apparatus becomes possible, and a power control means 50 for starting the supply of power to the heating units $\mathbf{14}_i$ in advance of the start of service by a fixed build-up time determined as the time for the heating units $\mathbf{14}_i$ to rise in temperature to the print ready region and for starting the supply of power to the circuits other than the heating units $\mathbf{14}_i$ exactly at the service start time.

Here, the "heating unit" is, for example, a heater used for preventing the photosensitive drum from absorbing moisture, a heater for the heat fixing unit, etc.

The above-mentioned fixed build-up time is set because it is necessary to wait for the temperature to rise to at least a certain value before starting the printing.

To use the apparatus, first, the desired service start time is input by the service start time input means 35.

Then, the power control unit 50 starts supplying power to the heating units $\mathbf{14}_i$ in advance of the set service start time by exactly a fixed build-up time so as to control the apparatus to enter the print-ready state at the service start time.

As explained above, the heating units $\mathbf{14}_i$ are controlled by the power control means 50 so as to start to be supplied with power in advance of the service start time set by the service start time input means 35 by a predetermined fixed build-up time and therefore enter the print ready state at the service start time.

However, the print-ready region of temperature widely fluctuates depending on the daily changes in temperature and humidity due to the season or weather or the environment in which the apparatus is placed, so the fixed build-up times of the heating units also vary in practice. Accordingly, the print ready state is not necessarily achieved exactly at the service start time.

This is due to the fact that while the time setting is controlled so as to start up the heaters before the service start time of the apparatus to enable immediate printing at the service start time, the build-up time of the heaters differs depending on the environment in which the apparatus is placed, so precise start-up is not possible.

That is, the build-up time until the print ready state is reached tends to become shorter the higher the external temperature compared with a reference external temperature. Conversely, it tends to become longer the lower the temperature compared with the reference external temperature.

Further, the build-up time until the print ready state is reached tends to become shorter the lower the humidity compared with a reference humidity and tends to become longer the higher the humidity compared with the reference humidity.

One method for eliminating such fluctuations is to supply power throughout the night so as to continually control the heaters and enable immediate printing. If power is supplied to the apparatus throughout the night, however, problems arise in terms of safety and conservation of energy.

In this way, when the print ready state has still not been reached at the service start time, the user has to wait further and therefore the input of the service start time becomes meaningless. Further, if the print-ready state is already reached before the service start time is reached, there are problems in terms of safety and wasted consumption of energy.

Here, the second embodiment of the present invention provides an easy-to-use and energy efficient image forming apparatus which enables use at exactly the service start time by measuring the build-up time during which a heating unit rises in temperature to the print ready region each time, for example, takes the average of the build-up times up to then and stores the same for use as the next build-up time, or predicts the build-up time of the heating unit to match the actual build-up time, or supplies the optimal amount of power, and a method for control of the same.

Figure 13:
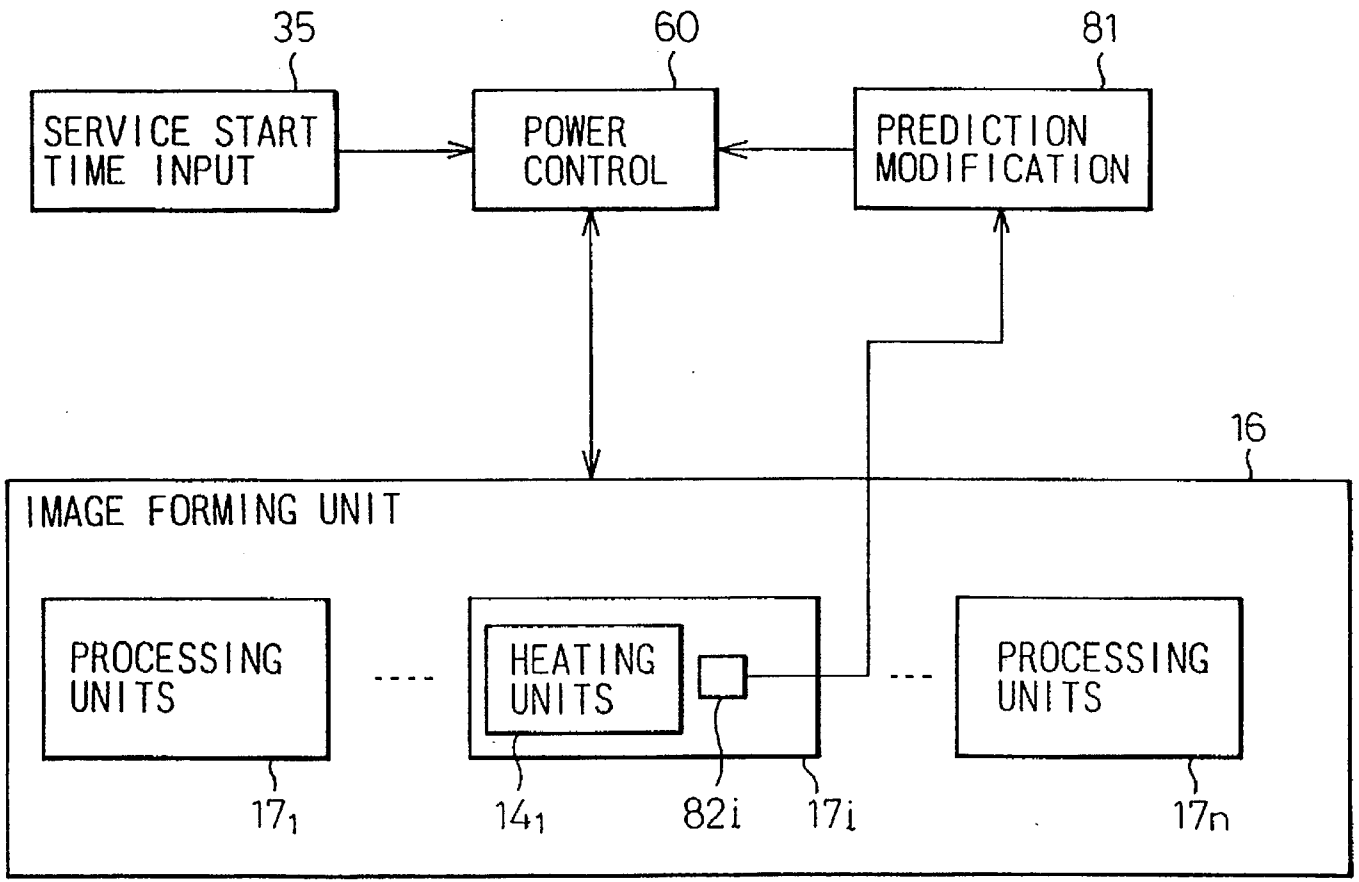
FIG. 13 is a block diagram of a first specific example for realization of the second embodiment.

FIG. 13 is a block diagram of a first specific example for realization of the second embodiment.

The first specific example, as shown in FIG. 13, is provided with an image forming unit 16 having a plurality of processing units $\mathbf{17}_l$ to $\mathbf{17}_n$, heating units $\mathbf{14}_i$ (i being a natural number of 1, 2 . . . ) provided at least at one of the plurality of processing units $\mathbf{17}_l$ to $\mathbf{17}_n$, an internal environment measuring unit $\mathbf{82}_i$ provided near the heating units $\mathbf{14}_i$ and measuring the temperature, humidity, and rest of the internal environment near the heating units 14*i*, a service start time input means 35 for inputting the service start time where use of the apparatus becomes possible, a power control means 60 for controlling the power supply to start the supply of a predetermined amount of power to the heating units $\mathbf{14}_i$ in advance of the service start time by the predicted build-up time and starting the supply of power to the apparatus as a whole at the service start time, and a prediction/modification means 81 for measuring and storing the changes along with time of the temperature, humidity, and other facets of the internal environment near the heating unit $\mathbf{14}_i$ measured by the internal environment measuring unit $\mathbf{82}_i$ and predicting the next build-up time and modifying the previous amount of power based on the changes along with time of the internal environment up to then.

Figure 14:
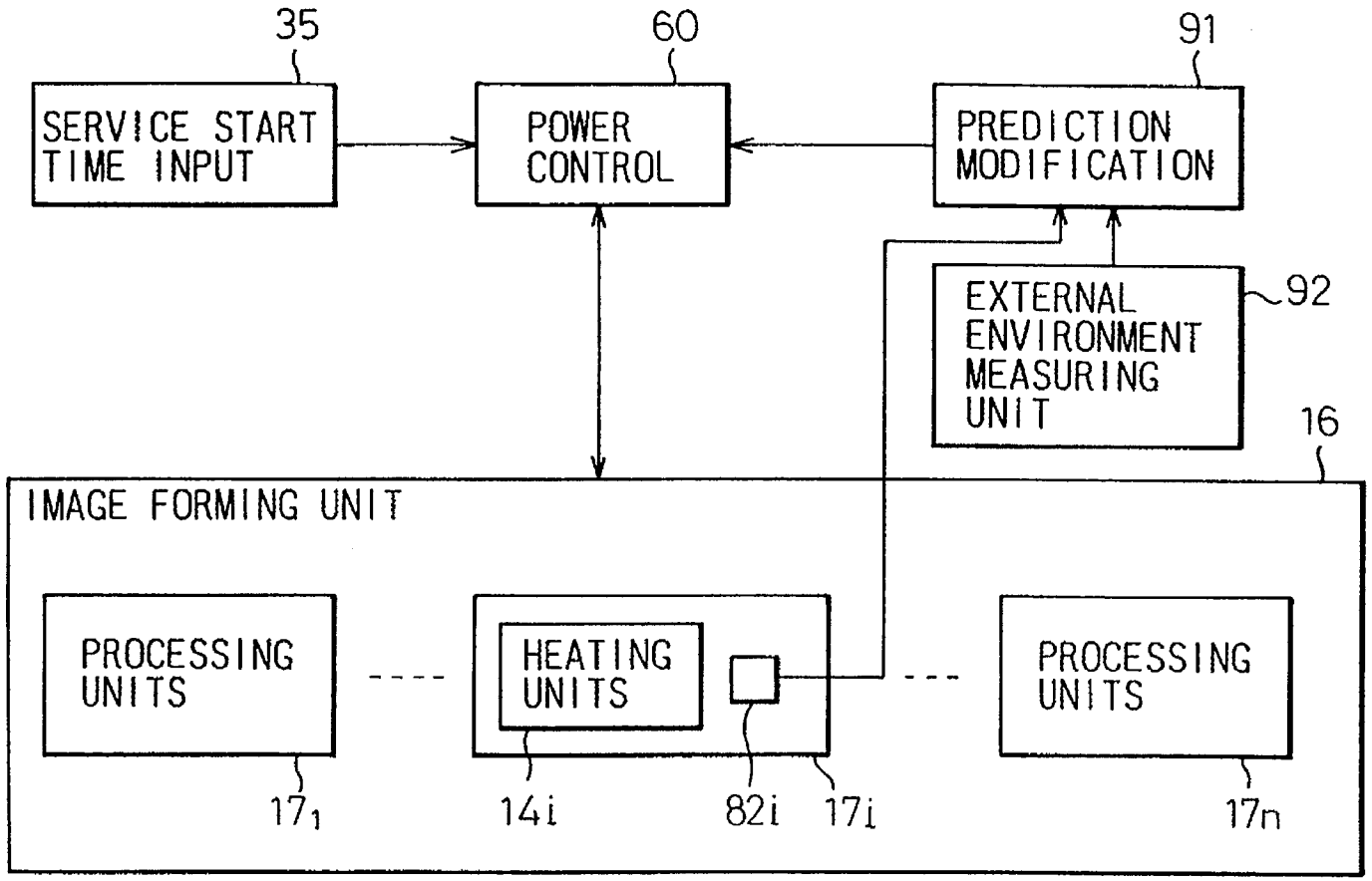
FIG. 14 is a block diagram of a second specific example for realization of the second embodiment.

FIG. 14 is a block diagram of a second specific example for realization of the second embodiment.

The second specific example, as shown in FIG. 14, is provided with an image forming unit 16 having a plurality of processing units $\mathbf{17}_l$ to $\mathbf{17}_n$, heating units 14*i* (i being a natural number of 1, 2 . . . ) provided at least at one of the plurality of processing units $\mathbf{17}_l$ to $\mathbf{17}_n$, an internal 10 environment measuring unit $\mathbf{82}_i$ provided near the heating units $\mathbf{14}_i$ and measuring the temperature, humidity, and rest of the internal environment near the heating units 14*i*, a service start time input means 35 for inputting the service start time at which use of the apparatus becomes possible, a power control means 60 for controlling the power supply to start the supply of a predetermined amount of power to the heating units 14*i* in advance of the service start time by the predicted build-up time and starting the supply of power to the apparatus as a whole at the service start time, an external environment measuring unit 92 for measuring the outside temperature, outside humidity, and rest of the external environment of the apparatus, and a prediction/modification means 91 for measuring and storing the changes along with time of the temperature, humidity, and other facets of the internal environment near the heating unit $\mathbf{14}_i$ measured by the internal environment measuring unit $\mathbf{82}_i$ and predicting the next build-up time and for modifying the previous amount of power based on the changes along with time of the internal environment up to then and the results of measurement of the external environment measuring unit 92.

Figure 15:
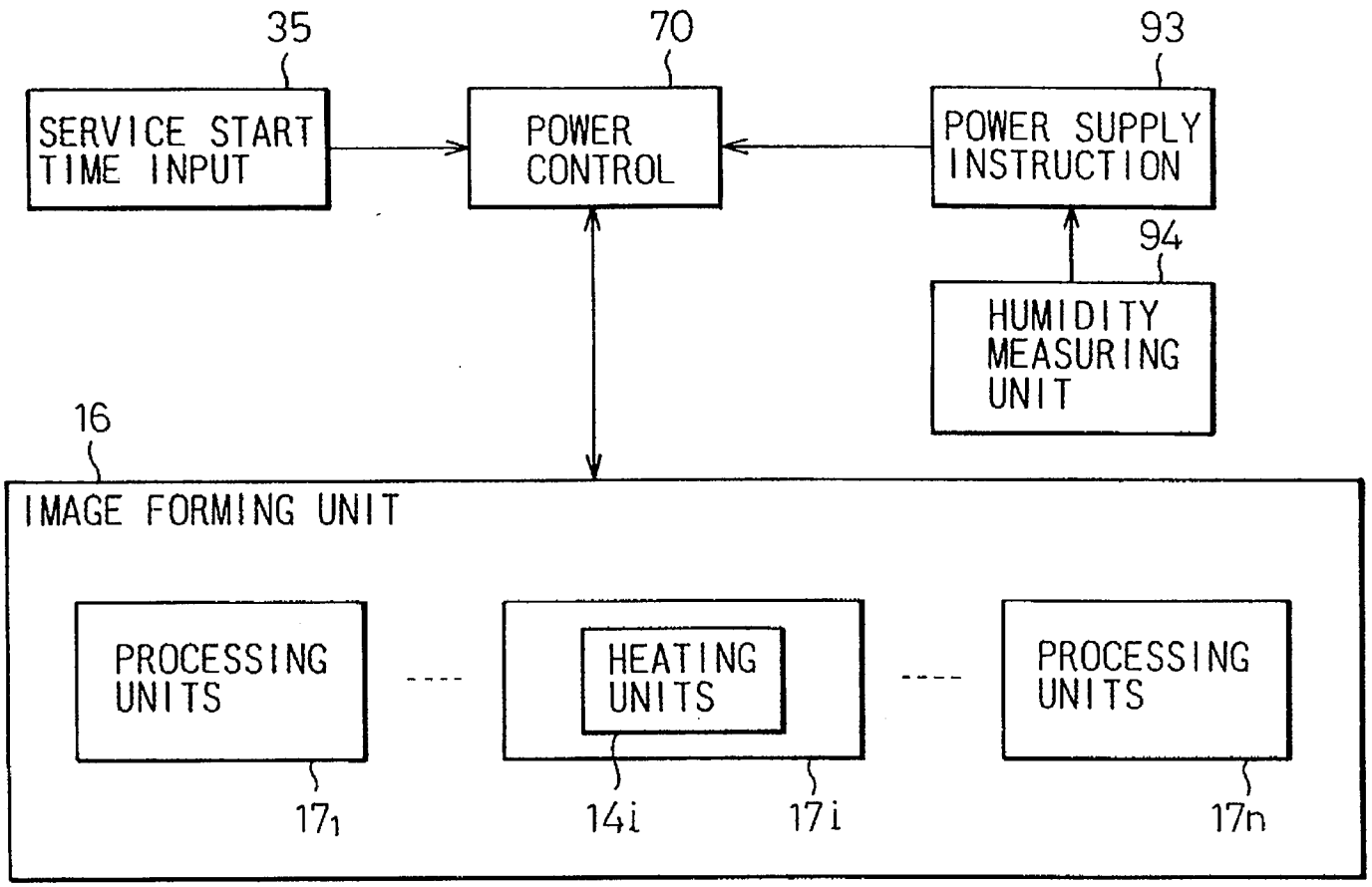
FIG. 15 is a block diagram of a third specific example for realization of the second embodiment.

FIG. 15 is a block diagram of a third specific example for realization of the second embodiment.

The third specific example, as shown in FIG. 15, is provided with an image forming unit 16 having a plurality of processing units $\mathbf{17}_l$ to $\mathbf{17}_n$, heating units 14*i* (i being a natural number of 1, 2 . . . ) provided at least at one of the plurality of processing units $\mathbf{17}_l$ to $\mathbf{17}_n$, a service start time input means 35 for inputting the service start time where use of the apparatus becomes possible, a humidity measurement unit 94 for measuring the humidity outside or inside of the apparatus, a power supply instructing means 93 for instructing the start of the supply of power to the heating unit 14*i* or the turn off of power to the same based on the measured humidity, and a power control means 70 for controlling the power source to start the supply of a predetermined amount of power to the heating units $\mathbf{14}_i$ in advance of the service start time by the predicted build-up time or when so instructed and starting the supply of power to the apparatus as a whole at the service start time.

Figure 16:
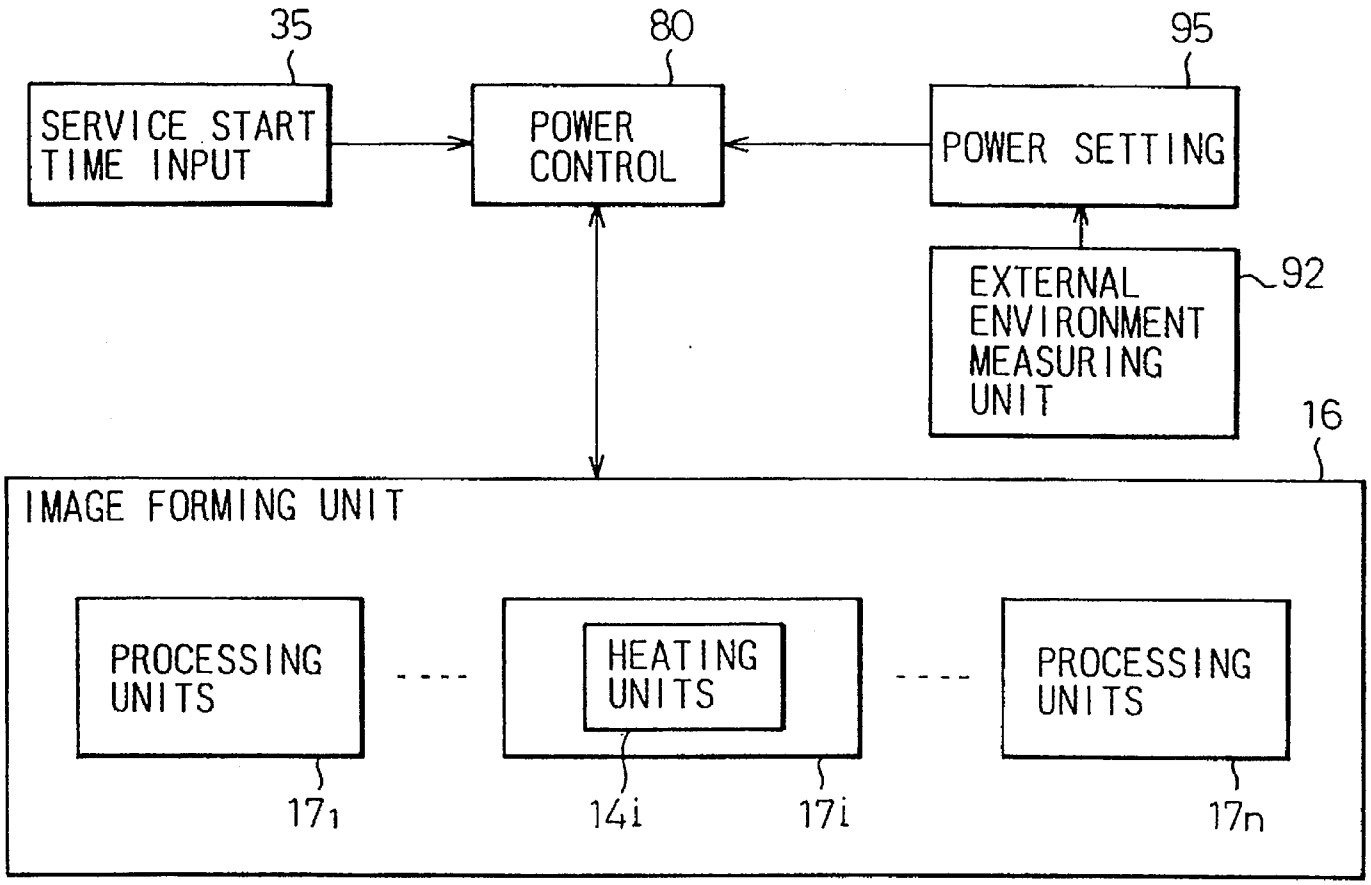
FIG. 16 is a block diagram of a fourth specific example for realization of the second embodiment.

FIG. 16 is a block diagram of a fourth specific example for realization of the second embodiment.

The fourth specific example, as shown in FIG. 16, is provided with an image forming unit 16 having a plurality of processing units $\mathbf{17}_l$ to $\mathbf{17}_n$, heating units 14*i* (i being a natural number of 1, 2 . . . ) provided at least at one of the plurality of processing units $\mathbf{17}_l$ to $\mathbf{17}_n$, a service start time input means 35 for inputting the service start time at which use of the apparatus becomes possible, an external environment measuring unit 92 for measuring the outside temperature, outside humidity, and rest of the external environment of the apparatus, a power setting means 95 for setting the optimal amount of power to be supplied to the heating units 14*i* based on the measurement results from the external environment measuring means 92, and a power control means 80 for controlling the power source to start the supply of the amount of power set by the power setting means 41 to the heating units $\mathbf{14}_i$ in advance of the service start time by a predetermined fixed build-up time and starting the supply of power to the apparatus as a whole at the service start time.

Figure 17:
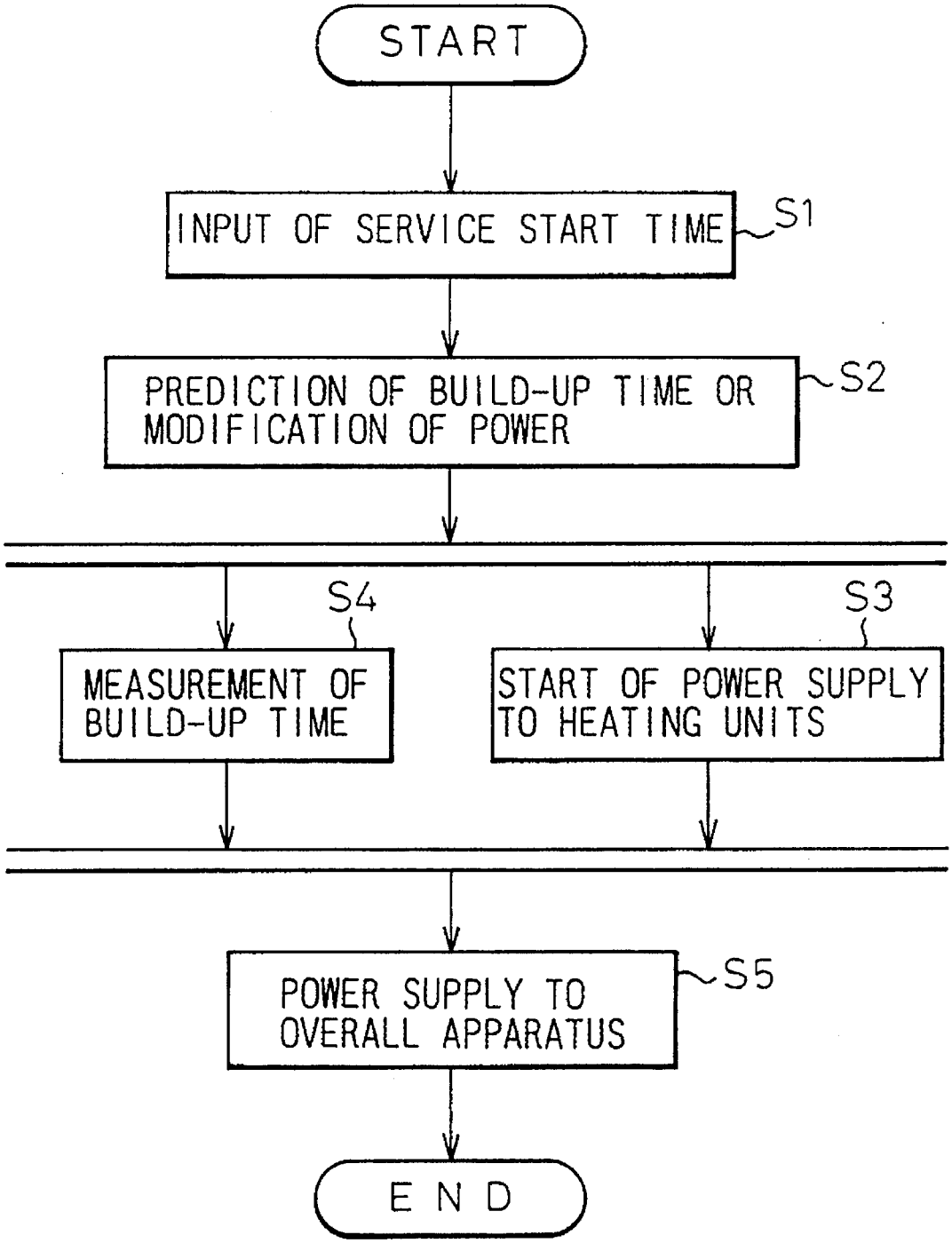
FIG. 17 is a flow chart of the method relating to the second embodiment.

FIG. 17 is a flow chart of the method relating to the second embodiment. When the service start time is input (step S1), the next build-up time is predicted (or the previous amount of power supplied to the heating units is modified) based on the change along with time of the temperature, humidity, and rest of the internal environment near the heating units measured up to then (step S2), the supply of a predetermined amount of power to the heating units is started in advance of the service start time by a predicted build-up time (or by a predetermined fixed build-up time) (step S3), the changes along with time of the internal environment from the start of the supply of power to the heating units to when the print ready region is reached are measured and stored (step S4), and the supply of power to the apparatus as a whole is started when the service start time is reached (step S5).

Here, the "image forming apparatus" has the same meaning as explained in the first embodiment.

Further, since the "power supply is started", it is assumed that the supply of power to the heating units $\mathbf{14}_i$was turned off once. This is different from an apparatus in which power is sent throughout the night, i.e., the supply of power to the heating units 14*i* is never turned off.

The "service start time" means the time from which use of the image forming apparatus becomes possible and can be freely set by the user.

The "build-up time" means the time from the start of the supply of power to when the print-ready state is reached for the at least one heating unit provided in the image forming apparatus. In the above-mentioned first, second, and third specific examples, this was made changeable in accordance with the state of the heating units. Note that there can be as many build-up times as there are heating units. On the other hand, in the fourth specific example, the build-up time is considered fixed and the amount of power supplied is made rather variable.

The "print ready region" means the region where printing is possible under a certain temperature, humidity, and other facets of the internal environment.

The "predetermined amount of power" means the amount of power enabling the heating units to reach the print ready region in the above-mentioned build-up time and does not have to be fixed with respect to the lapse of time. It may be changed by modifications by the prediction/modification means 91. There can be as many of these amounts as the number of heating units as well.

The "internal environment" means the temperature, humidity, and rest of the environment near the heating units $\mathbf{14}_i$ of the image forming apparatus, while the "external environment" means the temperature, humidity, and rest of the environment at a portion away from the heating units $\mathbf{14}_i$ in the image forming apparatus.

The "changes along with time of the internal environment" may include not only the changes in the build-up time from the start of power supply to the print ready region, but also the time dependency of the build-up, the build-up speed, and the build-up acceleration.

"Predicting the next build-up time and for changing the previous amount of power based on the changes along with time of the internal environment up to then" means, for example, <1> using the build-up time measured immediately before, <2> obtaining a mean value of the measured build-up times, a mode value (value with the greatest occurrence), interim value, longest value, shortest value, or other representative value for the build-up value just before and the one before that, for a certain number of successive build-up times running back from the one just before, for selected nonsuccessive past build-up times, or for all past build-up times, <3> examining from the build-up times measured in the past the trends in the changes in the same, the increasing trends, or the decreasing trends and correcting the values obtained by the above <1> or <2> by computation or a table etc. so as to comply with those trends, <4> not merely copying the past build-up time, but increasing or reducing the amount of power so as to either shorten the time or prolong it compared with the past build-up time, and <5> not merely looking at the length of time of the build-up time, but looking at the change along with time in the internal environment so as to enable the amount of power to be changed so that the temperature rises or the humidity falls efficiently.

An explanation will now be made of the flow chart of FIG. 17 with reference to the configuration of FIG. 13.

At step S1, the service start time is set by the service start time input means 35.

Next, at step S2, the prediction/modification means 81 predicts the next build-up time or changes the previous amount of power supplied to the heating units based on the changes along with time of the temperature, humidity, or other factors of the internal environment near the heating units measured up to then.

At step S3, the predetermined amount of power begins to be supplied to the heating units $\mathbf{14}_i$ in advance of the set service start time by the predicted build-up time.

At that time, at step S4, the prediction/modification means 81 measures and stores the change along with time in the internal environment of the heating units $\mathbf{14}_i$ from the start of the supply of power to the heating units $\mathbf{14}_i$ to when the print ready region is reached.

The second specific example (FIG. 14) differs from the first specific example (FIG. 13) in that the next build-up time is predicted or the amount of power modified based not only on the change along with time of the internal environment measured by the internal environment measurement unit $\mathbf{82}_i$, but also the results of measurement of the external environment measured by the external environment measurement unit 92.

The third specific example (FIG. 15) differs from the first and second specific examples (FIG. 13 and FIG. 14) in that the supply of power to the heating units is instructed based on the internal humidity or external humidity measured by the humidity measurement unit 94. By this, it is possible to generate heat so as to prevent absorption of moisture when the humidity is more than a set value and to end the supply of power when the humidity falls below a certain value.

The fourth specific example (FIG. 16) is one which does not predict the build-up time (the build-up time is made fixed), but changes the amount of power supplied to the heating units based on the external temperature, external humidity, or other factors of the external environment.

Note that the image forming apparatus to which the second embodiment is applied is the same in configuration as that shown in FIG. 7 and FIG. 8.

Figure 18:
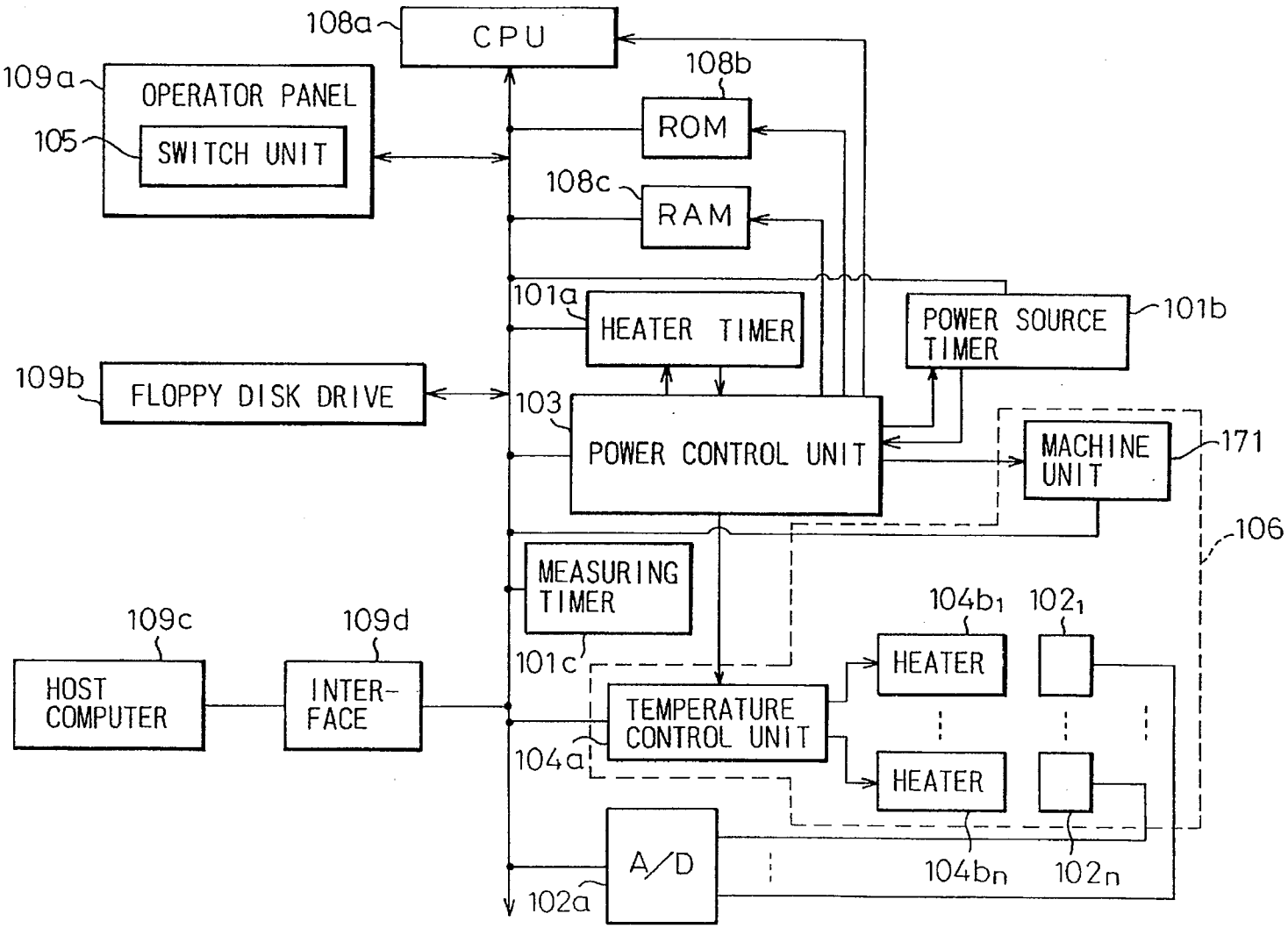
FIG. 18 is a block diagram of the system configuration corresponding to the first specific example.

FIG. 18 is a block diagram of the system configuration corresponding to the first specific example.

The printing apparatus shown in FIG. 18 is provided with a switch unit 105 provided at the operator panel 109*a* and corresponding to the service start time input unit for inputting or turning off the power or inputting the service start time, a floppy disk drive 109*b*, and an interface 109*d* for controlling the connection with the host computer 109*c* connected with the printing apparatus through a line.

The printing apparatus forms the image on the paper in accordance with the image information for printing given from the host computer 109*c*.

The floppy disk drive 109*b* and the host computer 109*c* are used for the automatic input or turnoff of power or input of the service start time by a program without intervention by an operator.

Further, provision is made of a CPU 108*a* for performing various types of control on the printing apparatus and a ROM 108*b* storing the program for the same, a nonvolatile RAM 108*c* storing various data, a machine unit $\mathbf{17}_l$ provided with various mechanisms for the processing units for the printing, such as the drums ($\mathbf{7}a_1$ to $\mathbf{7}a_4$) and optical systems ($\mathbf{7}b_1$ to $\mathbf{7}b_4$), and heaters $\mathbf{104}b_l$ to $\mathbf{104}b_n$ provided at a plurality of processing units and requiring supply of power from before the service start time in order to be usable from the set service start time.

Further, provision is made of a power source timer 101*b* for counting the service start time and instructing turning on and off of power to the power control unit 3 when the service start time has been reached, a heater timer 101*a* for counting the time for instructing the start or end of the supply of power to the heaters 104$b_l$ to 104$b_n$, a power control unit 103 for controlling the power source in various ways, such as instructing the supply of power to the heaters 104$b_l$ to 104$b_n$ or the other circuits based on an instruction from the power source timer 101*b* or the heater timer 101*a* or CPU 108*a*, and temperature sensors 102$_l$ to 102$_n$ corresponding to the internal environment measuring unit 82*i* and measuring the temperatures near the heaters 104$b_l$ to 104$b_n$ as the internal environment.

Here, the CPU 108*a*, the ROM 108*b* storing the program, the heater timer 101*a*, the power source timer 101*b*, the nonvolatile RAM 108*c* storing the predicted next build-up time or information on the next amount of power and input service start time, and the power control unit 103 for controlling the power source to start the supply of a predetermined amount of power to the heaters 104$b_l$ to 104$b_n$ in advance of the input service start time by the predicted next build-up time and start the supply of power to the color printing apparatus as a whole at the service start time.

The CPU 108*a*, the ROM 108*b* storing the program, the build-up time measurement timer 101*c*, and the nonvolatile RAM 108*c* for storing the build-up time measured up to the previous time or the next build-up time or information on the next amount of power measure and store the changes along with time of the temperatures of the heaters 104$b_l$ to 104$b_n$ measured by the temperature sensors 102$_l$ to 102$_n$ and predict the next build-up time based on the changes along with time of the temperature up to the past and therefore correspond to the above-mentioned prediction/modification means 81.

The power control unit 103 starts or ends the supply of power to the apparatus as a whole when instructed to input or cut off power by the power source timer 101*b*, switch unit 105, or host computer 109*c* and instructs the start or end of the supply of power to the heaters 104$b_l$ to 104$b_n$ when instructed to start or end the supply of power to the heaters 104$b_l$ to 104$b_n$ by the heater timer 101*a*.

In FIG. 18, the machine unit 171, temperature control unit 104*a*, and heaters 104$b_l$ to 104$b_n$ correspond to the image forming unit 106.

Figure 19A:
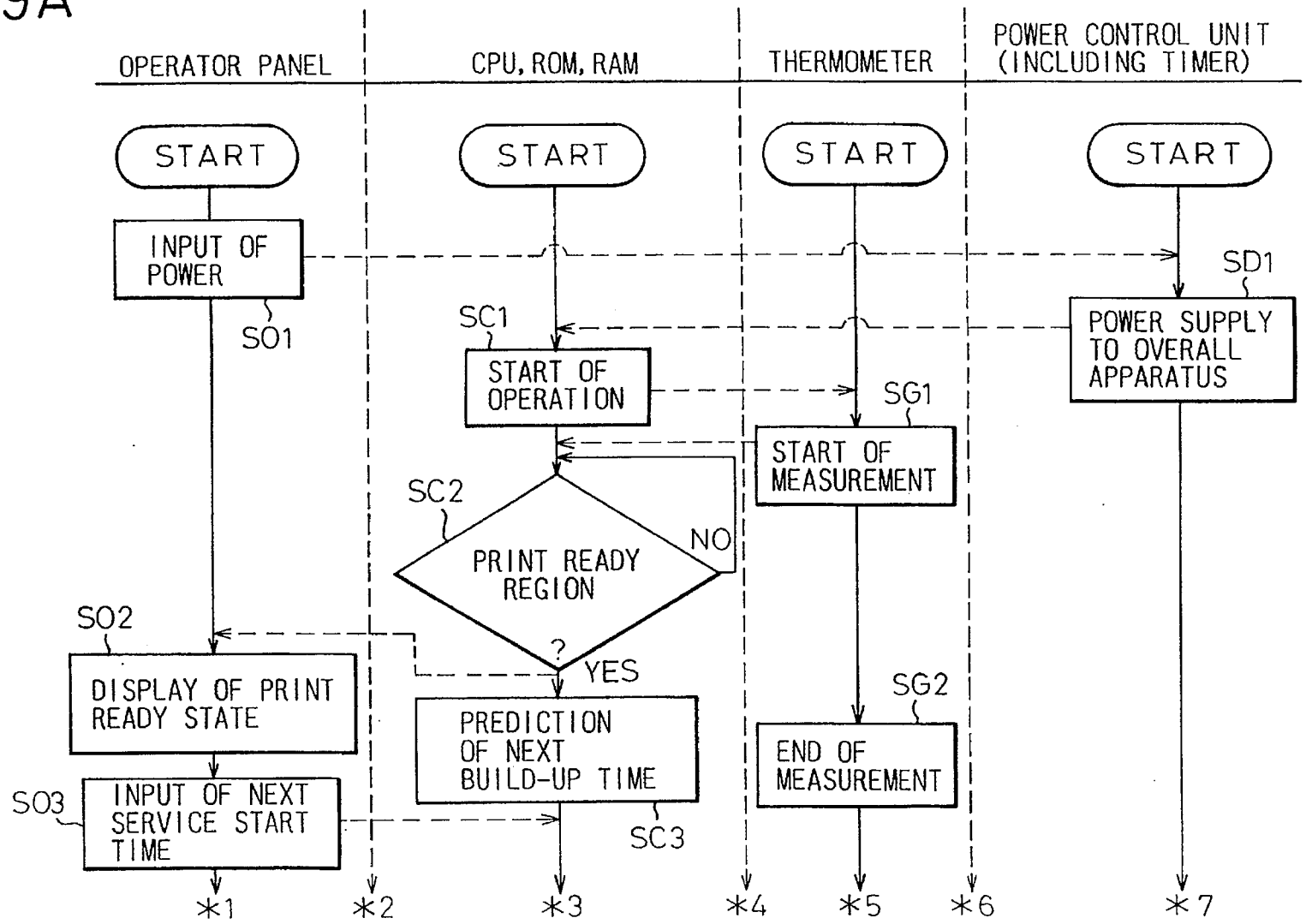
FIGS. 19A and 19B are flow charts for explaining the operation in the system shown in FIG. 18.
Figure 19B:
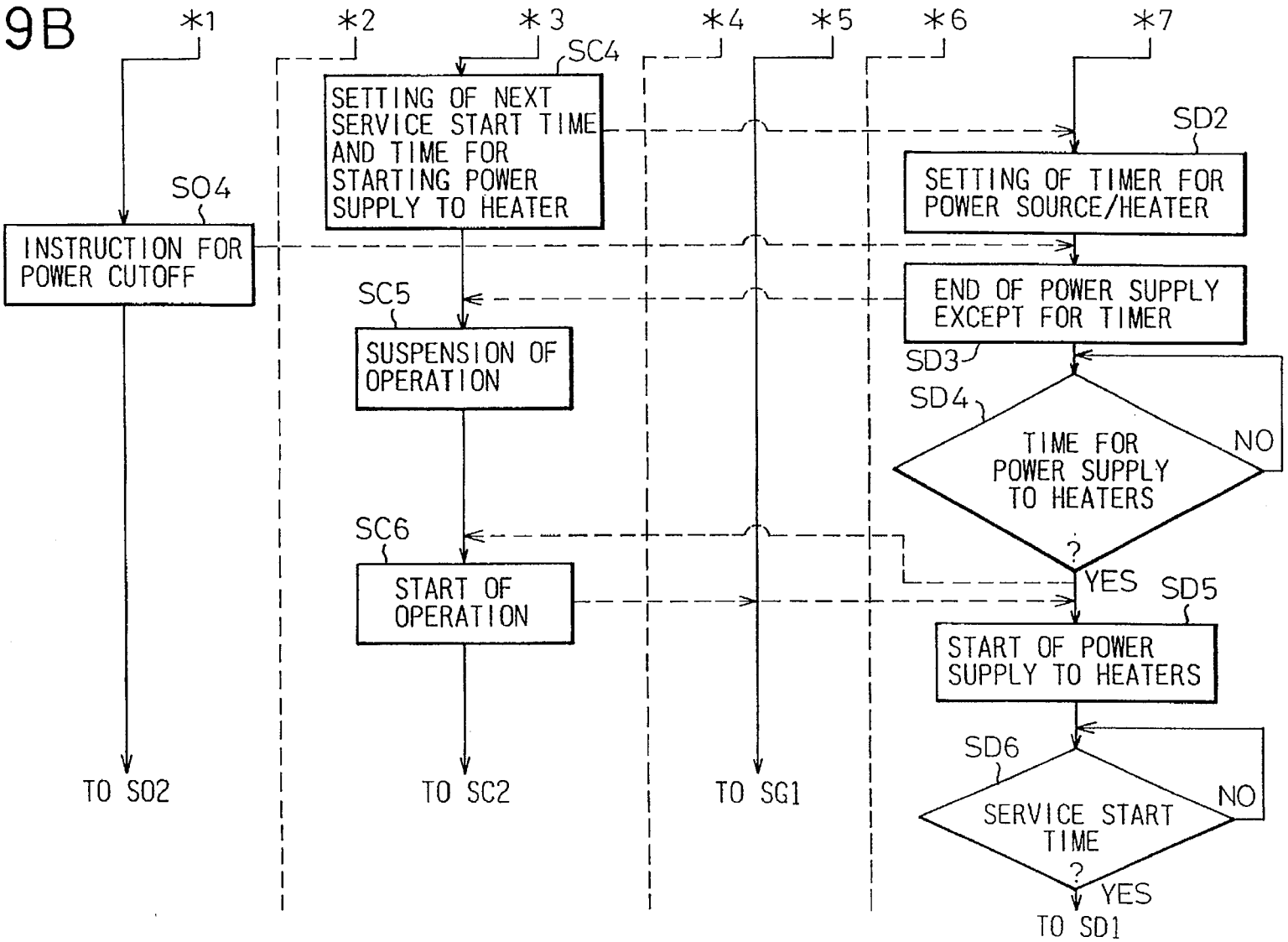

FIGS. 19A and 19B are flow charts for explaining the operation in the system shown in FIG. 18.

As shown in FIGS. 19A and 19B, at step SO1, when there is an instruction for input of power from the switch unit 105 provided at the operator panel 109*a* or from the host computer etc., the power control unit 103 starts the supply of power to the apparatus as a whole, including the heaters 104$b_l$ to 104$b_n$, at step SD1.

This being done, the CPU 108*a* corresponding to the prediction/modification means (81), the ROM 108*b* storing the program, the measurement use timer 101*c* for measuring the build-up time, and the nonvolatile RAM 108*c* in which the previously measured build-up time is stored start to operate at step SC1 and the temperature sensors 102$_l$ to 102$_n$ such as the thermistors provided near the heaters 104$b_l$ to 104$b_n$ are instructed to start measuring the temperature.

The temperature sensors 102$_l$ to 102$_n$ start measurement at step SG1. The information on the measured temperature is sent out to the RAM 108*c* along with the time information from the measurement use timer 101*c* (provided with clock generator and timer counter). The prediction/modification means, that is, the CPU 108*a* and program, determine if the temperatures of the heaters have reached the printable condition.

When it is determined that the temperature measured at step SC2 has reached the print ready region, the time indicated by the measurement timer 101*c* as the build-up time is stored in the RAM 108*c* as the measured build-up time.

At step SC3, the CPU 108*a* and the program serving as the prediction/modification means (81) predict the next build-up time based on the measured build-up time stored in the RAM 108*c*.

The next build-up time is predicted by the prediction/modification means, that is, the CPU 108*a* and program, for example, by using the build-up time $t_p$ measured just before, by obtaining the mean value of a certain number of the most recently measured (for example, w number) build-up times ($t_p$, $t_{p-1}$, $t_{p-2}$, $t_{p-3}$ . . . $t_{p-w+1}$), or by the above-mentioned <2> and <3>.

When obtaining the average of the latest w number of times, the following is performed:

$(\Sigma t_i)/w$

The predicted build-up time is stored once in the RAM 108*c*.

When it is determined at step SC2 that the heaters 104$b_l$ to 104$b_n$ have reached the print ready region, the color printing apparatus has reached the print ready state and the measurement by the temperature sensors 102$_l$ to 102$_n$ is ended at step SG2. At this time, it is possible to display the fact that printing is possible on the operator panel 109*a* at step SO2.

After this, at step SO3, there is an input of the next service start time from the switch unit 105 of the operator panel 109*a* and this is stored in the RAM 108*c*. At step SC4, the CPU 108*a* and program etc. determine the next time for starting the supply of power to the heaters for starting the supply of power to the heaters 104$b_l$ to 104$b_n$ by subtraction of the "predicted build-up time" from the "time for start of use" At step SD2, the next time for start of use is set in the power source timer 101*b* and the next time for start of supply of power to the heaters is set in the heater timer 101*a*.

Next, at step SO4, when there is an instruction from the operator (user) through the switch unit 105 or through the host computer 109*c*, etc., to turn off the power, the power control unit 103 ends the supply of power to the circuits other than the power source timer 101*b* and heater timer 101*a* at step SD3.

This being done, at step SC5, the CPU 108*a*, etc., also stop operating.

The heating unit timer 101*a* counts the set time for start of supply of power to the heaters. When the time for start of supply of power to the heaters is reached at step SD4, an instruction is given to the power control unit 103 at step SC6 to supply power to the CPU 108*a* etc. to start them operating. Based on an instruction from the CPU 108*a*, at step SD5, power begins to be supplied to the heating units 104$b_l$ to 104$b_n$ as well.

After this, when the power source timer 101*b* counts the time for start of use at step SD6, the routine proceeds to step SD1, where the supply of power to the apparatus as a whole is started.

In this way, the routine of step SO2 to step SO4 is repeated at the operator panel 109*a*, the routine of step SC2 to step SC6 is repeated for the CPU 108*a* and the program, the routine of step SG1 to step SG2 is repeated for the temperature sensors 102$_1$ to 102$_n$, and the routine of step SD1 to step SD6 is repeated for the power control unit 103, heater timer 101*a*, and power source timer 101*b*.

Figure 20:
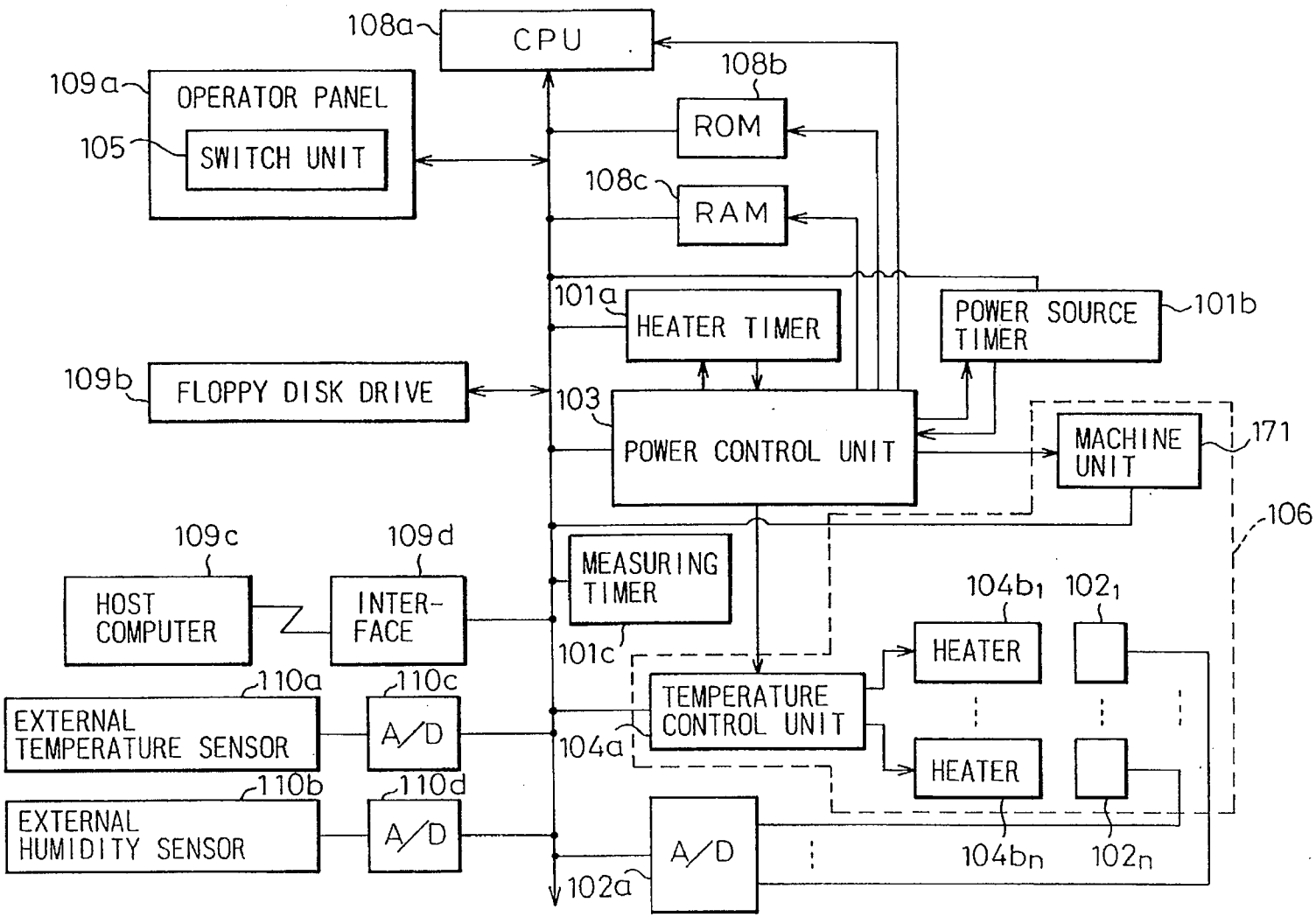
FIG. 20 is a block diagram of the system configuration corresponding to the second specific example.

FIG. 20 is a block diagram of the system configuration corresponding to the second specific example. In the color printing apparatus shown in FIG. 20, unlike with the case of FIG. 18, provision is made of an external thermometer 110*a* and external hygrometer 110*b* as the external environment measuring unit 92 and the A/D converters 110*c* and 110*d*, so when predicting the build-up time, the external temperature and the external humidity are input.

Using the external temperature measured by the external temperature sensor 110*a*, the shift time obtained from the calorific capacity of the heaters $\mathbf{104}b_l$ to $\mathbf{104}b_n$ are calculated by the CPU 108*a* and the program. At the time of start-up of the heaters, the build-up time obtained from the change along with time in the internal environment by the internal environment measuring unit 82*i* is changed by the amount of the shift time and the supply of power is started in advance of that time.

This enables more accurate prediction.

Further, by changing the temperature of the heater in the print ready region by calculating the temperature required in accordance with the external temperature conditions and external humidity conditions, it becomes possible to reduce the power consumption.

Further, a fifth specific example will next be explained. This fifth specific example differs from the case shown in FIG. 18 and FIG. 20 in that humidity is countered when turning off power based on the results of 3,5 measurement by an external humidity sensor 110*b* serving as the external environment measuring unit shown in FIG. 20 or the humidity sensor (not shown) of the internal environment measuring unit (82*i*).

That is, after power to the color printing apparatus is turned off, the results of measurement by a humidity sensor provided outside the apparatus or at the photosensitive drums etc. are used so as to start the supply of power to the heaters to prevent absorption of moisture in accordance with a CPU 108*a* and program when the humidity reaches more than a certain value and so as to stop the supply of power to the heaters when they fall below a certain value. This enables absorption of moisture by the photosensitive drums etc. to be effectively prevented even without supply of power throughout the night.

In the second embodiment explained above, the build-up time of the heaters, which fluctuates tremendously in time depending on the environment in which the printing apparatus is placed, is measured each time, is averaged with the build-up time up to then, and then stored for prediction of the next build-up time.

Accordingly, it becomes possible to accurately predict the build-up time and to start the printing from the set time of start of use.

Further, when a plurality of heating units are provided in a printing apparatus, there are individual build-up times for the individual heating units and the build-up times may differ. Accordingly, to ensure that the printing apparatus as a whole be placed in a printable condition at the time of start of use, the times for start of the supply of power become different for each heating unit.

Further, the heater timer and the power source timer were explained as being separate circuits, but in the same way as in the first embodiment, the heater timer and the power source timer may also be made a common circuit.

Further, the internal environment measuring unit (82*i*) was explained with reference to the case of use of only a temperature sensor for measuring the temperature, but the invention is not limited to this case. Both a temperature sensor and a humidity sensor may also be used as the internal environment measuring unit.

The numbers of the heaters and the numbers of the temperature sensors explained in the examples are no more than examples. The invention, of course, is not limited to the same.

As explained above, in the second embodiment of the present invention, the next build-up time until the print ready region of the heating unit provided in the image forming apparatus is reached is predicted based on the past actually measured build-up times, the temperature of the heating units, and other measurement results and the power starts to be supplied to the heating units in advance of the set service start time by the build-up time.

Accordingly, the image forming apparatus becomes able to print at the set service start time, so it is possible to provide an image forming apparatus which is easy to use and which has a good energy efficiency.

We claim:

1. An image forming apparatus comprising:

an image forming unit having a plurality of processing units, heating units provided at least at one of the said plurality of processing units, a mode input unit for inputting one of information of a continuous mode for having the heating units continuously perform their heating operation and information of a timed mode for instructing the time for start of heating by the heating units prior to a service start time, a time input unit for inputting the information showing time for start of supply of power to the heating units in the timed mode, and a power control means for continuously supplying power to the heating units when the mode information input from the mode input unit is continuous mode information and for supplying or turning off power to the heating units based on information showing the time for starting the power supply, input by said time input unit, when the mode information is the timed mode information.

2. An image forming apparatus as set forth in claim 1, wherein said power control means comprises:

a mode decision/instruction unit for determining the input mode, setting the time for start of the supply of power in a heating unit timer in the case of selection of the timed mode, and instructing the continuation of the supply of power to the heating units in the case of turn-off of power to a power control unit in the case of selection of the continuous mode, the heating unit timer counting the time until the set start of the supply of power and instructing the start of supply of power to the power control unit when the time for start of the supply of power has been reached, and the power control unit supplying power to or turning power off from the various circuits when instructed to input or turn off power, starting the supply of power to the heating units when instructed to start the supply of power by the heating unit timer, and continuing the supply of power to the heating units when instructed to continue the supply of power to the heating units even after turn-off of power to the apparatus as a whole in the case of an instruction to continue the power supply by the mode decision/instruction unit.

3. An image forming apparatus as set forth in claim 2, further comprising:

a power input/cutoff unit for instructing the input or turn-off of power or instructing the input or turn-off of power at a set time, wherein the power control means is provided with a mode decision/instruction unit for determining the selected mode, setting the time for start of the supply of power in the timer in the case of the selection of the timed mode, and instructing the continuation of the supply of power to the heating units in the case of turn-off of power to the power control unit in the case of selection of the continuous mode, wherein said timer measures the set time for the start of the supply of power and instructing the start of the power supply to the power control unit when the time for start of the supply of power has been reached and measures the time set by the power input/cutoff unit and instructing the input or turn-off of power to the power control unit when the time has been reached, and wherein said power control unit supplies power to or turns off power from the various circuits when instructed to input or turn off power by the timer or the power input/cutoff unit, starts the supply of power to the heating units when instructed to start the supply of power by the timer, and continues the supply of power to the heating units even when power to the apparatus as a whole has been turned off when instructed to continue the power supply by the mode decision/instruction unit.

4. An image forming apparatus as set forth in claim 3, wherein power is input under instruction from a host computer, floppy disk drive, etc.

5. An image forming apparatus as set forth in claim 1, wherein a switch unit is provided for manual input of the mode information, input of the time, input of the power, or turn off of the power and a floppy disk drive and a host computer are used for the automatic input of the mode, input of the time, and input or turn-off of power by a program.

6. An image forming apparatus comprising:

an image forming unit having a plurality of processing units;

heating units used at the time of warmup and provided at least at one of the plurality of processing units and printing heating units used at the time of printing;

a power input/cutoff unit for instructing the input or turn-off of power or instructing the input or turn-off of power at a set time;

a warmup mode input unit for inputting one of information on a continuous mode for continuously performing a heating operation of the warmup heating units and information of a timed mode for instructing the time for start of the heating by the heating units, a time input unit for inputting information showing the time for start of the supply of power to the heating units in the timed mode; and a power control unit, wherein said power control unit is provided with a warmup mode decision/instruction unit for determining the selected mode, setting the time for start of the supply of power in a heating unit timer in the case of the selection of the timed mode, and instructs the continuation of the supply of power to the warmup heating units when turning off power to the power control unit in the case of selection of the continuous mode, wherein said timer counts the time set start of the supply of power, instructs the start of the supply of power to the power control unit when the time for starting the power supply is reached and also measures the time set by the power input/cutoff unit and instructs the input or turn-off of power to the power control unit when that time has been reached, and wherein said power control unit changes over the supply of power from the warmup heating units to the printing heating units and starts the supply of power to other circuits when instructed to input power by the timer or the power input/cutoff unit, turns off power to the circuits when instructed to turn off power by the timer or the power input/cutoff unit, starts the supply of power to the warmup heating units prior to a service start time when instructed to start the supply of power by the timer, and continues the supply of power to the warmup heating units even after the turn-off of power to the apparatus as a whole when instructed to continue the supply of power by the warmup mode decision/instruction unit.

7. An image forming apparatus as set forth in claim 6, wherein a switch unit is provided for manual input of the mode information, input of the time, input of the power, or turn-off of the power and a floppy disk drive and a host computer are used for the automatic input of the mode, input of the time, and input or turn-off of power by a program.

8. An image forming apparatus as set forth in claim 6, wherein instead of the warmup heating units and printing heating units as the heating units, provision is made of a plurality of similar heating units and the number used for generating heat for the warmup and printing is specified.

9. An image forming apparatus comprising:

an image forming unit having a plurality of processing units;

heating units provided at least at one of the plurality of processing units;

an environment measuring means for measuring the environment surrounding the image forming apparatus;

a service start time input means for inputting the service start time where use of the apparatus becomes possible; and a power control means for controlling the power source to start the supply of a predetermined amount of power to the heating units in advance of the service start time by a predicted build-up time and starting the supply of power to the apparatus as a whole at the service start time.

10. An image forming apparatus as set forth in claim 9, wherein said environment measuring means comprises an internal environment measuring unit provided near the heating units and measuring the temperature, humidity, and rest of the internal environment near the heating units; and said image forming apparatus further comprises a prediction/modification means for measuring and storing the changes along with time of the temperature, humidity, and other facets of the internal environment near the heating units measured by the internal environment measuring unit and predicting the next build-up time and changing the previous amount of power based on the changes along with time of the internal environment up to then.

11. An image forming apparatus as set forth in claim 10, wherein the said environment measuring means is comprised of an external environment measuring unit for measuring the outside temperature, outside humidity, and rest of the external environment of the apparatus, wherein said prediction/modification means measures and stores the changes along with time of the temperature, humidity, and other facets of the internal environment near the heating units measured by the internal environment measuring unit and predicts the next build-up time and changes the previous amount of power based on the changes along with time of the internal environment up to then and the results of measurement of the external environment measuring unit.

12. An image forming apparatus as set forth in claim 10, wherein to predict the next build-up time and to modify the previous amount of power based on the changes along with time of the internal environment up to then, <1> use is made of the build-up time measured immediately before, <2> a mean value of the measured build-up times, a mode value (value with the greatest occurrence), interim value, longest value, shortest value, or other representative value for the build-up value just before and the one before that, for a certain number of successive build-up times running back from the one just before, for selected nonsuccessive past build-up times, or for all past build-up times is obtained, or <3> examination is made from the build-up times measured in the past of the trends in the changes in the same, the trends in increase, or the trends in decrease and correcting the values obtained by the above <1> or <2> by computation or a table etc. so as to comply with those trends.

13. An image forming apparatus as set forth in claim 10, wherein said prediction/modification means comprises a CPU, a ROM storing a program, a counting timer for counting a build-up time, and a RAM storing the previously measured build-up times.

14. An image forming apparatus as set forth in claim 10, wherein said internal environment measuring unit is provided with at least one of a temperature sensor and a humidity sensor.

15. An image forming apparatus as set forth in claim 9, wherein said environment measuring means comprises a humidity measurement unit for measuring the humidity outside or inside of the apparatus, wherein said image forming apparatus further comprises a power supply instructing means for instructing the start of the supply of power to the heating units or the turn-off of power to the same based on the measured humidity, wherein said power control means controls the power source to start the supply of a predetermined amount of power to the heating units in advance of the service start time by the predicted build-up time or when so instructed and starts the supply of power to the apparatus as a whole at the service start time.

16. An image forming apparatus comprising:

an image forming unit having a plurality of processing units;

heating units provided at least at one of the plurality of processing units;

a service start time input means for inputting the service start time where use of the apparatus becomes possible;

an external environment measuring unit for measuring the outside temperature, outside humidity, and rest of the external environment of the apparatus;

a power setting means for setting the optimal amount of power to be supplied to the heating unit based on the measurement results from the external environment measuring means; and a power control means for controlling the power source to start the supply of the amount of power set by the power setting means to the heating units in advance of the service start time by a predetermined fixed build-up time and starting the supply of power to the apparatus as a whole at the service start time.

17. A method for controlling an image forming apparatus comprising the steps of:

(S1) selecting one of a timed mode and a continuous mode in an image forming apparatus having heating units and inputting the time for start of supply of power to the heating units prior to a service start time whenever the timed mode is selected;

(S2) determining the selected mode;

(S3) counting the time until the set start of the supply of power when the time mode has been selected;

(S4) starting the supply of power to the heating units when the scheduled time for start of supply of power has been reached after the power turn-off; and (S5) continuing the supply of power to the heating units even when turning off power to the apparatus as a whole when the continuous mode has been selected.

18. A method for controlling an image forming apparatus comprising the steps of:

(S1) inputting a service start time in an image forming apparatus having at least one heating unit;

(S2) predicting a next build-up time or changing an amount of power previously supplied to the heating units based on changes along with time in the temperature, humidity or other facets of the internal environment near the heating units as measured up to then;

(S3) starting the supply of a predetermined amount of power to the heating units in advance of the service start time by a predicted build-up time;

(S4) measuring and storing the changes along with time in the internal environment from the start of supply of power to the heating units up until when the print ready region is reached; and (S5) starting to supply power to the apparatus as a whole when the service start time is reached.

* * * * *